US006431069B2

(12) United States Patent
Fujishiro

(10) Patent No.: US 6,431,069 B2
(45) Date of Patent: Aug. 13, 2002

(54) DEVICE FOR SEPARATING A NEW PRINTING PLATE FROM A PLATE CYLINDER

(75) Inventor: Shinichi Fujishiro, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/858,941

(22) Filed: May 17, 2001

(30) Foreign Application Priority Data

May 17, 2000 (JP) ..... 2000-144886

(51) Int. Cl.[7] ..... B41L 47/14
(52) U.S. Cl. ..... 101/477; 101/484
(58) Field of Search ..... 101/415.1, 477, 101/409, 484

(56) References Cited

U.S. PATENT DOCUMENTS 5,259,314 A * 11/1993 Sugiyama ..... 101/477
5,443,006 A * 8/1995 Beisel et al. ..... 101/477
5,526,747 A * 6/1996 Marmin et al. ..... 101/477
5,595,119 A 1/1997 Hada et al. ..... 101/477
5,701,822 A 12/1997 Métrope ..... 101/477

FOREIGN PATENT DOCUMENTS

JP 8-108525 A 4/1996
JP 3032484 U 10/1996

* cited by examiner

*Primary Examiner*—Leslie J. Evanisko

(57) ABSTRACT

A printing plate changing device prevents a new printing plate from being damaged even if an abnormal attachment has occurred during/before attaching the printing plate on a plate cylinder. Various sensors detect a rear end of the new printing plate located near an extrusion member when a phase of the lower plate cylinder forwardly rotating is positioned at a predetermined position, an actuator of the lower printing plate holding device is extended by a control device in accordance with a signal from the sensors to release a hook from an engaged pin. A claw portion is rotated by force energized by a spring to advance into a stored portion. The claw portion of the hook is engaged with the rear end of the new printing plate so that the new printing plate can be returned into the stored portion by extending the actuator.

13 Claims, 20 Drawing Sheets

DEVICE FOR SEPARATING A NEW PRINTING PLATE FROM A PLATE CYLINDER

The entire disclosure of Japanese Patent Application No. 2000-144886 filed on May 17, 2000 including specification, claims, drawings, and abstract is incorporated herein by reference in its entirety.

BACKGROUND OF THE INVENTION

1. Field of the Invention

The present invention relates to a printing plate changing device for supplying a new printing plate to a plate cylinder of a printing press.

2. Description of Related Art

As a conventional printing plate changing device for supplying a new printing plate on a plate cylinder of a printing press, devices disclosed in Japanese Utility Model Registration No.3032484 and Japanese Patent Publication No. Hei8-108525 is known.

In the printing plate holding device disclosed in Japanese Utility Model Registration No. 3032484, a new printing plate can be supplied to a plate cylinder by pivotally releasing a hook for holding the new printing plate in a printing plate supplement frame by an operation unit. In a printing plate holding device disclosed in Japanese Patent Publication No. Hei8-108525, a new printing plate is set into a new printing plate cassette. An end portion of the new printing plate is engaged with a claw member for supporting a rear end of the new printing plate. The claw member for supporting the rear end of the new printing plate is moved by a new printing plate feeding air-cylinder device along a printing plate supplement direction. By pivoting the claw member for supporting the rear end of the new printing plate by a claw releasing cam in order to release the engagement with the end portion of the new printing plate while the claw member is moved, the new printing plate can be supplied to the plate cylinder.

In the printing plate changing device disclosed in Japanese Utility Model Registration No. 3032484, a hook for holding a new printing plate is engaged/released by pivoting an exclusive operation unit. The number of parts becomes large such that a total weight of the device becomes heavy and its cost becomes high. On the other hand, in the printing holding device disclosed in Japanese Patent Publication No. Hei8-108525, an operation for setting a new printing plate is complicated since the new printing plate must be inserted into the cassette for the new printing plate while the claw member for supporting the rear end of the printing plate is operated.

If the printing plate is abnormally attached to a plate cylinder, the abnormally attached printing plate must be released from the corresponding plate cylinder by rotating a plate cylinder in a reverse direction with respect to a printing plate supply direction. The other plate cylinders are reversely rotated in synchronization with the reverse rotation of the plate cylinder. Therefore, to avoid being damaged, a gripped end of a printing plate should be wound on the other plate cylinder during/before an attachment operation in the reverse rotation.

SUMMARY OF THE INVENTION

It is an object of the present invention to provide a printing plate change device for supplying a new printing plate to a plate cylinder that comprises a new printing plate releasing means for releasing an end portion of the new printing plate at a downstream side along a new printing plate supplement direction from the plate cylinder.

It is another object to provide in the printing plate change device according to the present invention, the printing plate releasing means releases the end portion from the plate cylinder in the case that the new printing plate is wrongly attached.

It is another object to provide in the printing plate change device according to the present invention, the printing plate change device comprises a new printing plate storing means having a stored portion for storing the new printing plate, wherein the new printing plate releasing means is characterized of moving the new printing plate so as to store the new printing plate in the stored portion of the new printing plate storing means.

It is still another object to provide in the printing plate change device according to the present invention, the new printing plate releasing means comprises a new printing plate engagement member for engaging with the end portion of the new printing plate at an upstream side along a new printing plate supplement direction.

To solve the above problem, in the printing plate changing device according to the present invention, the new printing plate releasing means comprises a new printing plate engagement member movably arranged at the new printing plate storing means and engaging with the end portion of the new printing plate at the upstream side with respect to a new printing plate supplement direction.

To solve the above problem, in the printing plate changing device according to the present invention, the printing plate changing device comprises a new printing plate releasing member provided at a downstream side along a new printing plate storing direction with respect to a stored position at an upstream side of the new printing plate storing means along the new printing plate supplement direction, wherein the new printing plate releasing member backwardly moves the new printing plate engagement member from the stored portion of the new printing plate storing means by moving the new printing plate engagement member toward the downstream side along the new printing plate supplement direction.

To solve the above problem, in the printing plate changing device according to the present invention, the printing plate changing device comprises moving means for moving the new printing plate storing means between an operation position for supplying the new printing plate to the plate cylinder and a shelter position released from the plate cylinder, wherein the new printing plate engagement member is advanced to the stored portion of the new printing plate storing means to engage with an end portion of the new printing plate by moving the new printing plate storing means to the operation position by the moving means, and new printing plate engagement member is movably provided with respect to the new printing plate storing means to backwardly move from the stored portion of the new printing plate storing means by moving the new printing plate engagement member to the shelter position of the new printing plate storing means by the moving means.

To solve the above problem, in the printing plate changing device according to the present invention, the upstream side of the stored portion along the new printing plate supplement direction is located at a location lower than the downstream side of the new printing plate along the new printing plate supplement direction in the case that the new printing plate storing means is in the shelter position, the new printing plate engagement member is pivotally supported on the new printing plate storing means, in the case that the new printing plate storing means is located at the storing position, the new printing engagement member is located at a downstream side along a new printing plate supplement direction with respect to an upstream end of the storing portion of the new printing plate storing means along the new printing plate supplement direction, and a distance between a pivotal point at the stored position of the new printing plate engagement member and the end portion at the upstream side of the stored portion of the new printing plate storing means along the new printing plate supplement direction is longer than a distance between the pivotal point and a front end of the new printing plate engagement member.

To solve the above problem, the printing plate changing device according to the present invention further comprises an energizing member for advancing the new printing plate engagement member toward the stored portion, and a contacting member for backwardly moving the new printing plate engagement member from the stored portion of the new printing plate storing means against force urged by the energizing member by contacting with the new printing plate engagement member.

To solve the above problem, in the printing plate changing device according to the present invention, the new printing plate releasing means moves an end portion of the new printing plate at a downstream side along a new printing plate supplement direction along a substantially radial direction of the plate cylinder.

To solve the above problem, in the printing plate changing device according to the present invention, the new printing plate releasing means includes a swing plate provided near the plate cylinder.

To solve the above problem, the printing plate changing device according to the present invention comprises a discharged printing plate storing means having a stored portion for storing a discharged printing plate discharged from the plate cylinder, wherein the new printing plate releasing means releases an upstream end portion of the discharged printing plate along a discharged printing plate storing direction, which is stored in a stored portion of the discharged printing plate storing means, from the plate cylinder.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
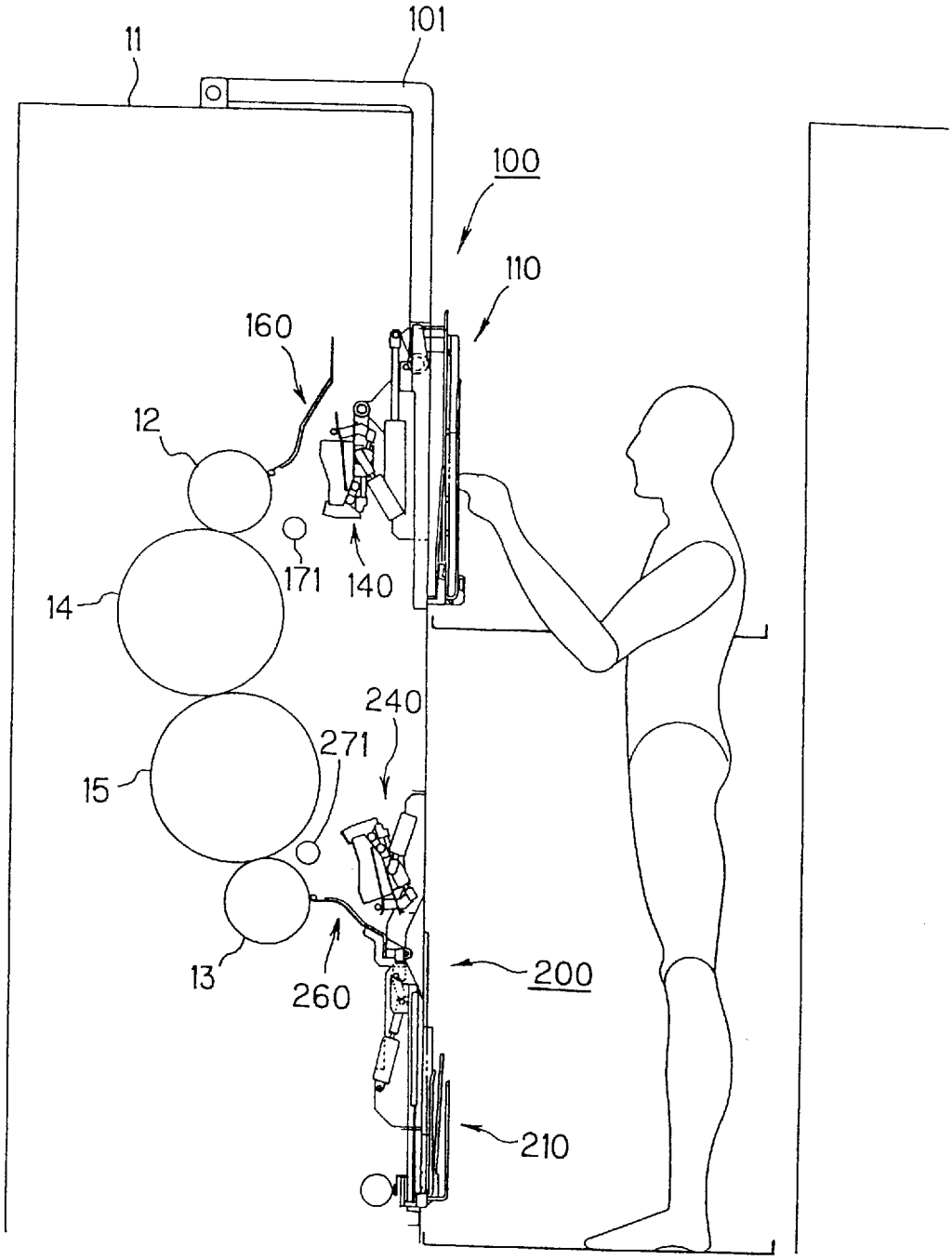
FIG. 1 is a schematic view of an embodiment of a printing plate changing device suitable for a double-sided printing press according to the present invention.
Figure 2:
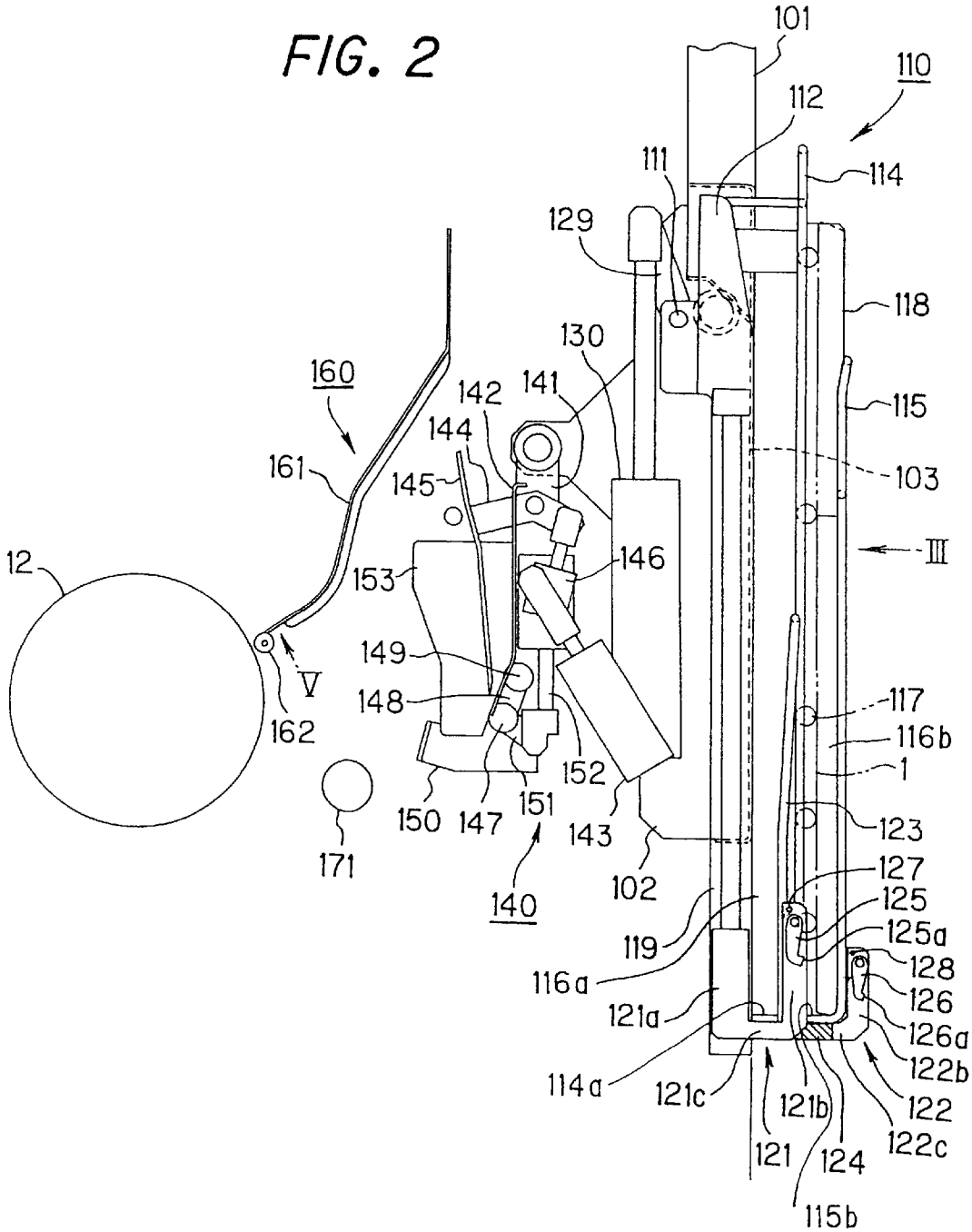
FIG. 2 is a schematic view of an upper printing plate exchange device shown in FIG. 1.
Figure 3:
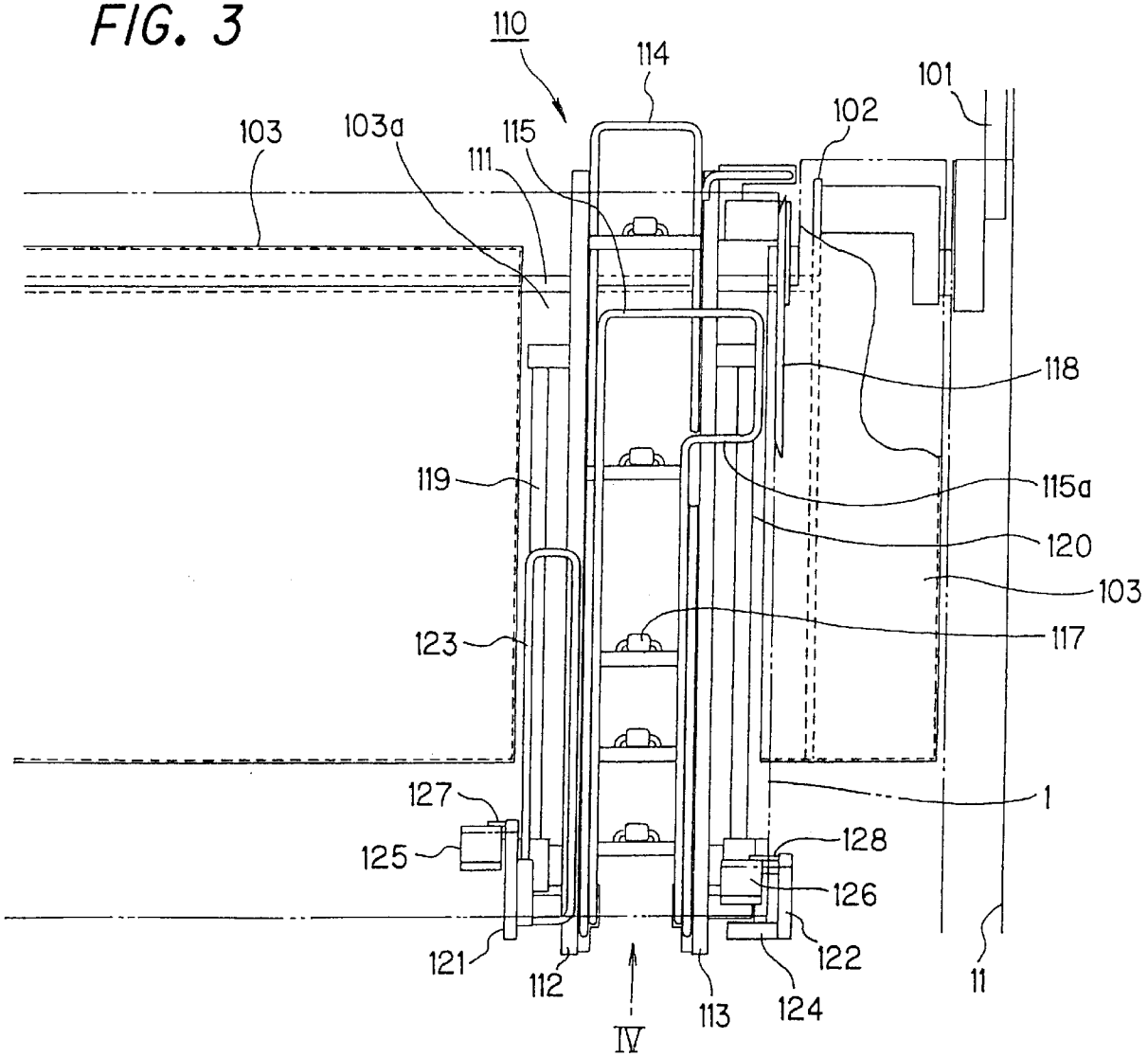
FIG. 3 is a partially enlarged view of the device taken along a line III—III in FIG. 2.
Figure 4:
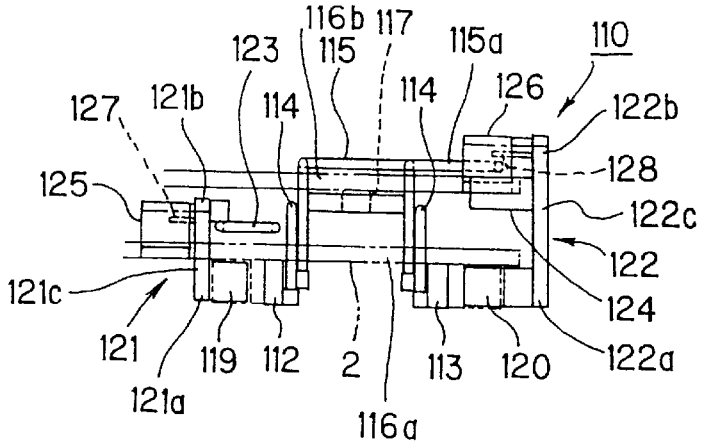
FIG. 4 is a partially enlarged view of the device taken along a line IV—IV in FIG. 3.
Figure 5:
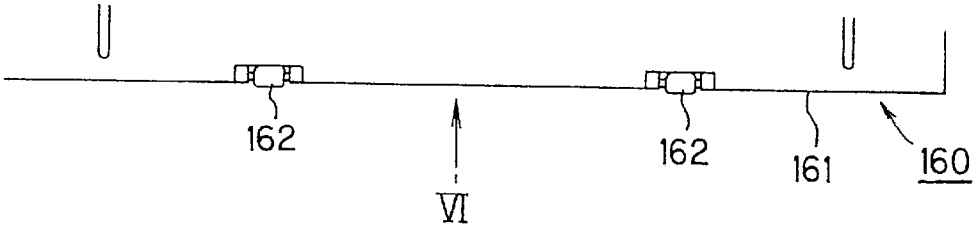
FIG. 5 is a partially enlarged view of the device taken along a line V—V in FIG. 2.
Figure 6:
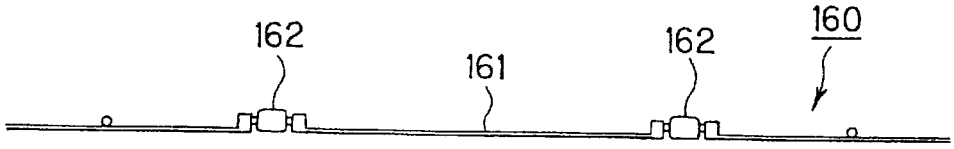
FIG. 6 shows a device taken along a line VI—VI in FIG. 5.
Figure 7:
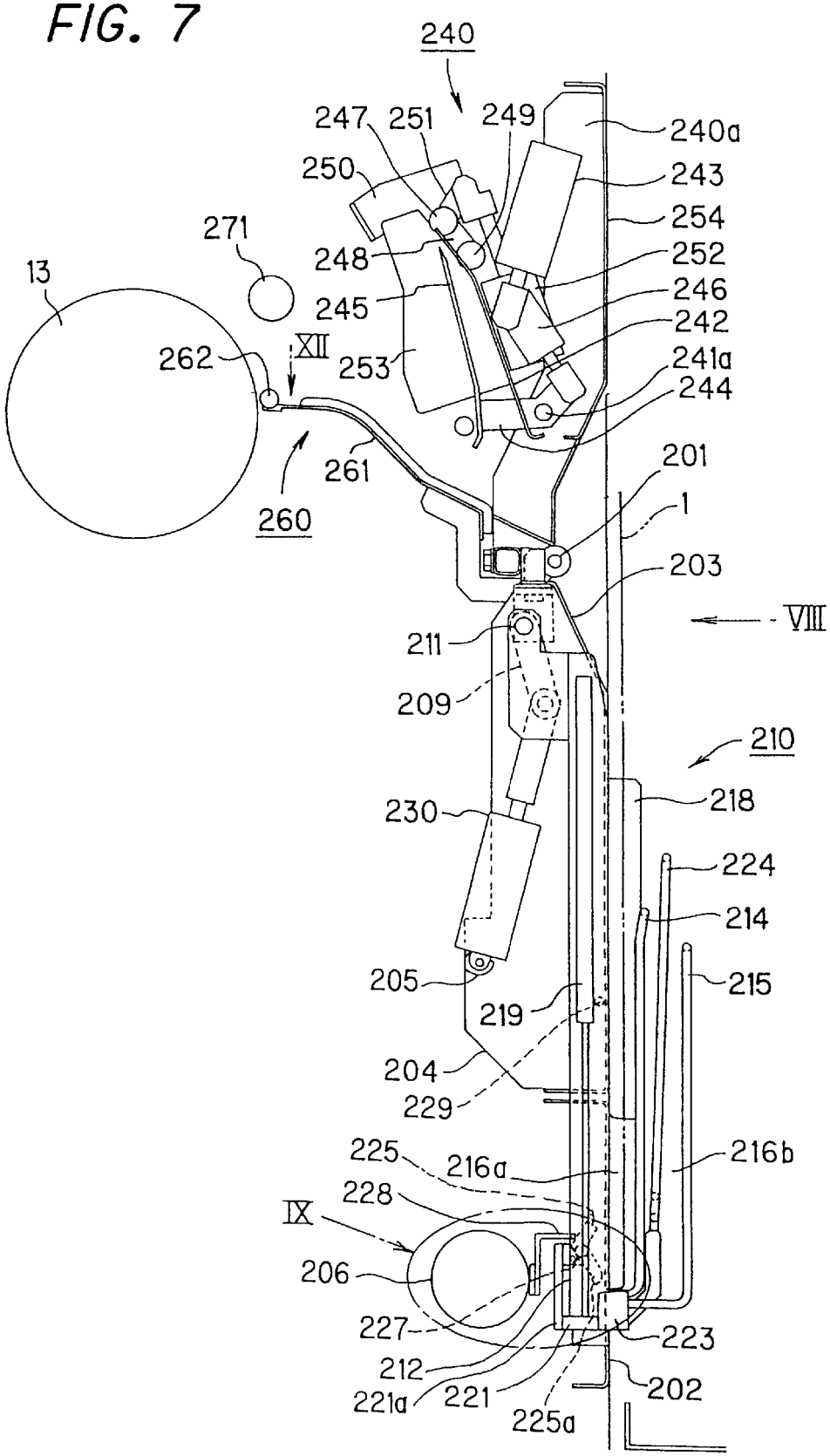
FIG. 7 is a schematic view of a lower printing plate exchange device shown in FIG. 1.
Figure 8:
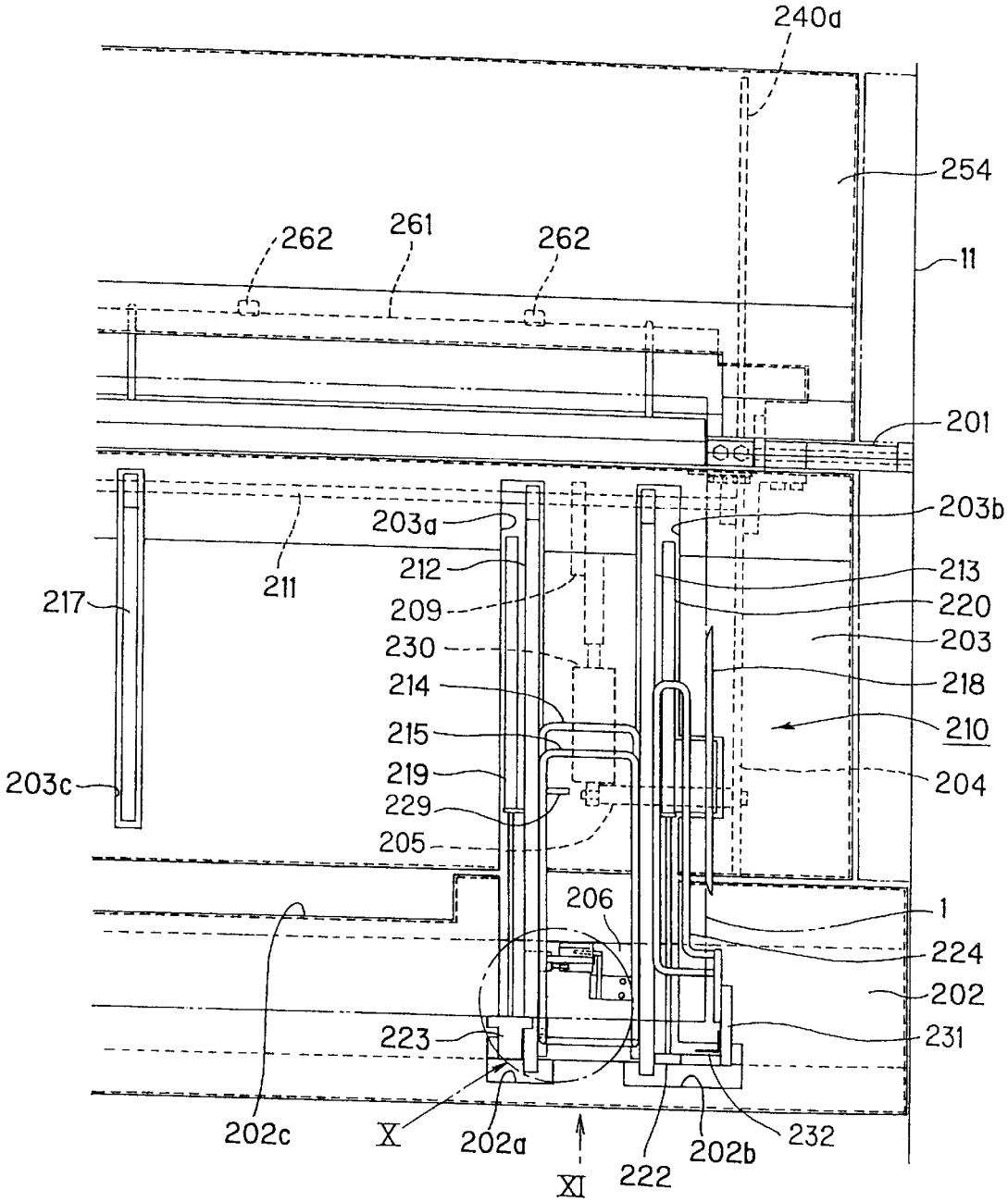
FIG. 8 is a partially enlarged view of the device taken along a line VIII—VIII in FIG. 7.
Figure 9:
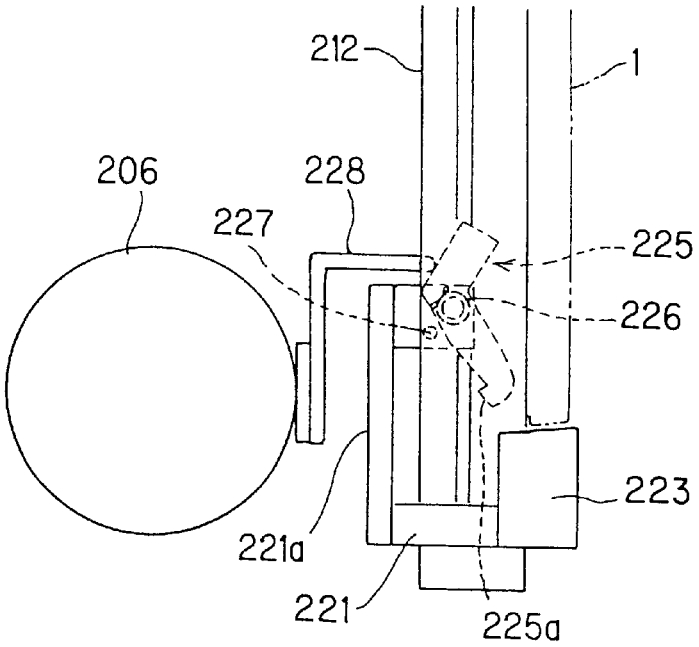
FIG. 9 is a partially enlarged view of the device taken along a line IX—IX in FIG. 7.
Figure 10:
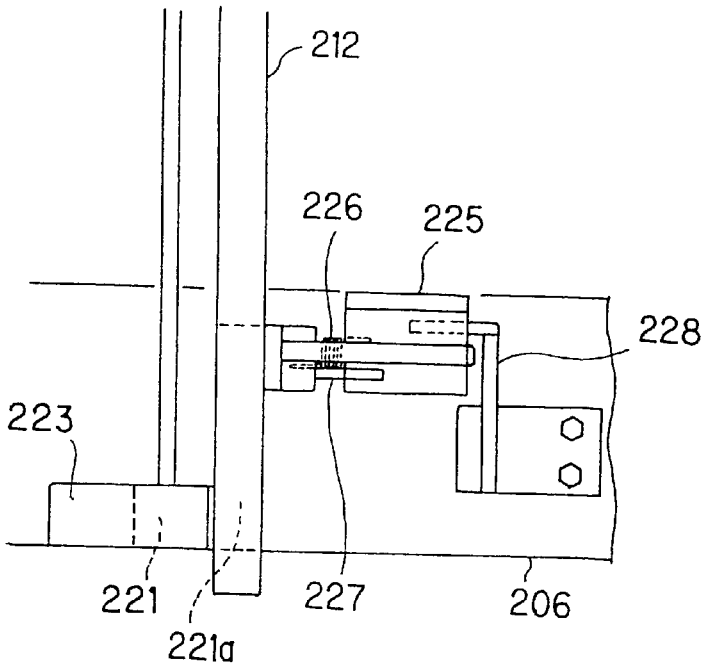
FIG. 10 is a partially enlarged view of the device taken along a line X—X in FIG. 8.
Figure 11:
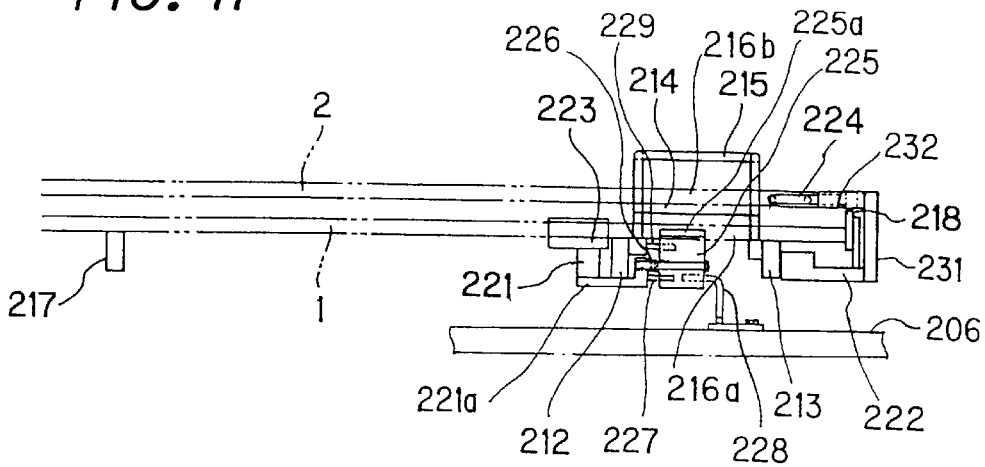
FIG. 11 is a partially enlarged view of the device taken along a line XI—XI in FIG. 8.
Figure 12:
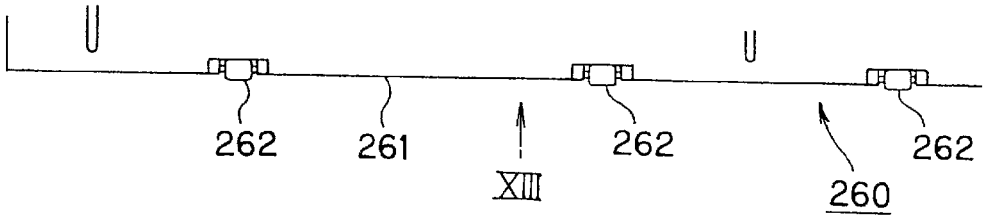
FIG. 12 shows a device taken along a line XII—XII in FIG. 7.
Figure 13:
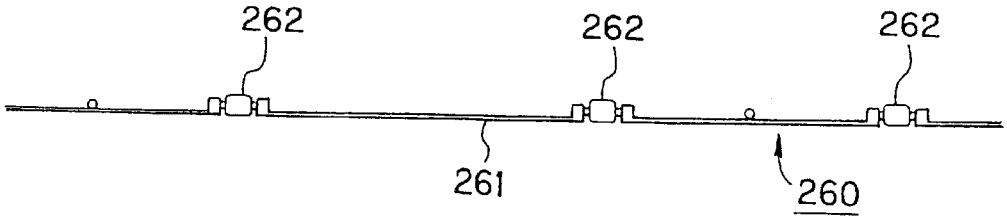
FIG. 13 shows a device taken along a line XIII—XIII in FIG. 12.

Printing Plate Changing Device:

An embodiment of a printing plate changing device according to the present invention adapted in a double-sided printing press is described with reference to FIG. 1 to FIG. 13. FIG. 1 is a schematic view of the printing press changing device. FIG. 2 is a schematic view of an upper portion of the device shown in FIG. 1. FIG. 3 is a partial enlarged view of the device taken along a line III—III in FIG. 2. FIG. 4 is a partial enlarged view of the device taken along a line IV—IV in FIG. 3. FIG. 5 is a partial enlarged view of the device taken along a line V—V in FIG. 2. FIG. 6 shows a device taken along a line VI—VI in FIG. 5. FIG. 7 is a schematic view of a lower portion of the device shown in FIG. 1. FIG. 8 is a partially enlarged view taken along a line VIII—VIII shown in FIG. 7. FIG. 9 is a partial enlarged view taken along a line IX—IX as shown in FIG. 7. FIG. 10 is a partial enlarged view taken along a line X—X as shown in FIG. 8. FIG. 11 is a partially enlarged view taken along a line XI—XI as shown in FIG. 8. FIG. 12 is a partial enlarged view taken along a line XII—XII shown in FIG. 7. FIG. 13 shows a device taken along a line XIII—XIII in FIG. 12.

As shown in FIG. 1, an upper plate cylinder 12 is provided at a location between a pair of upper right- and upper left-portions of the frames 11 of a printing unit. The upper plate cylinder 12 is in contact with an upper blanket cylinder 14. On the other hand, a lower plate cylinder 13 is provided at a location between a pair of lower right- and lower left-frames 11. The lower plate cylinder 13 is in contact with a lower blanket cylinder 15. The upper blanket cylinder 14 and the lower blanket cylinder 15 are in contact with each other and a printed medium, such as a web member, is passed between the pair of the blanket cylinders 14, 15.

When ink and dampening water are supplied from an ink supply device and a water supply device (not shown) to the plate cylinders 12, 13, respectively, ink corresponding to a picture pattern on plates of the plate cylinders 12, 13 is transferred to the blanket cylinders 14, 15, respectively, so that both sides of the printed medium are printed by passing between the blanket cylinders 14, 15.

In the present embodiment, an upper printing portion comprises the upper plate cylinder 12, the upper blanket cylinder 14, the ink supply device, and the water supply device, and a lower printing portion comprises the lower plate cylinder 13, the lower blanket cylinder 15, the ink supply device, and the water supply device.

Upper Printing Plate Exchange Device:

As shown in FIG. 1, an upper printing plate exchange device 100 is provided near the upper plate cylinder 12. The upper printing plate exchange device 100 comprises the following components.

At each upper end of the right- and left-frames 11, one end of a pair of L-shaped support arms 101 are supported to rotate in the same rotational direction as the upper plate cylinder 12. As shown in FIG. 2 and FIG. 3, the opposite end of the support arms 101 are supported to rotate in the same rotational direction as the upper plate cylinder 12.

Upper Printing Plate Holding Device:

The upper printing plate exchange device 100 includes an upper printing plate holding device 110. The upper plate holding device 110 is supported between the support frames 102 such that it rotates in the same rotational direction as the upper plate cylinder 12. The upper plate holding device 110 comprises the following components.

As shown in FIG. 2 and FIG. 3, a supporting axis 111 is connected and supported at a location between the support frames 102 to rotate in the same rotational direction as the upper plate cylinder 12. Each end portion of a pair of plate-shaped guide frames 112, 113, arranged along an axial direction, is connected and supported to a respective end of the supporting axis 111.

As shown in FIG. 2 to FIG. 4, each opposite end of the guide frames 112 (113) is connected and fixed at a base end portion 114*a* (115*b*) of the first- (second-) guide portion 114 (115) extending toward one end of the guide frame 112 (113) substantially parallel to the longitudinal direction of the guide frame 112 (113).

A space is provided between the guide frames 112, 113 and the first guide member 114 to form a stored portion 116*a* for storing a discharged printing plate 2. When the upper holding device 110 is positioned as shown in FIG. 2, one end of the discharged plate 2 stands on the base end portion 114*a* of the first guide member 114, a surface of the discharged printing plate 2 is supported by the guide frames 112, 113 and the opposite surface of the discharged plate 2 is supported by the first guide member 114.

A space is provided between the first and second guide members 114, 115 to form a stored portion 116*b* for storing a new printing plate 1. When the upper plate holding device 110 is positioned as shown in FIG. 2, a new printing plate 1 stands on the base end portion 115*b* of the second guide portion 115, one surface of the new printing plate 1 is supported by the first guide member 114, and the opposite surface of the new printing plate 1 is supported by the second guide member 115.

In the above embodiment, means for storing a discharged printing plate can be constituted by the guide frames 112, 113, the first guide member 114, and so on, and means for storing a new printing plate can be constituted by the first and second guide members 114, 115, and so on.

One end of a link plate 129 is connected and fixed at the supporting axis 111. At the opposite end of the link plate 129, a front end of an actuator 130 is pivotally connected. A base end of the actuator 130 is pivotally supported by the support frame 102.

Figure 14:
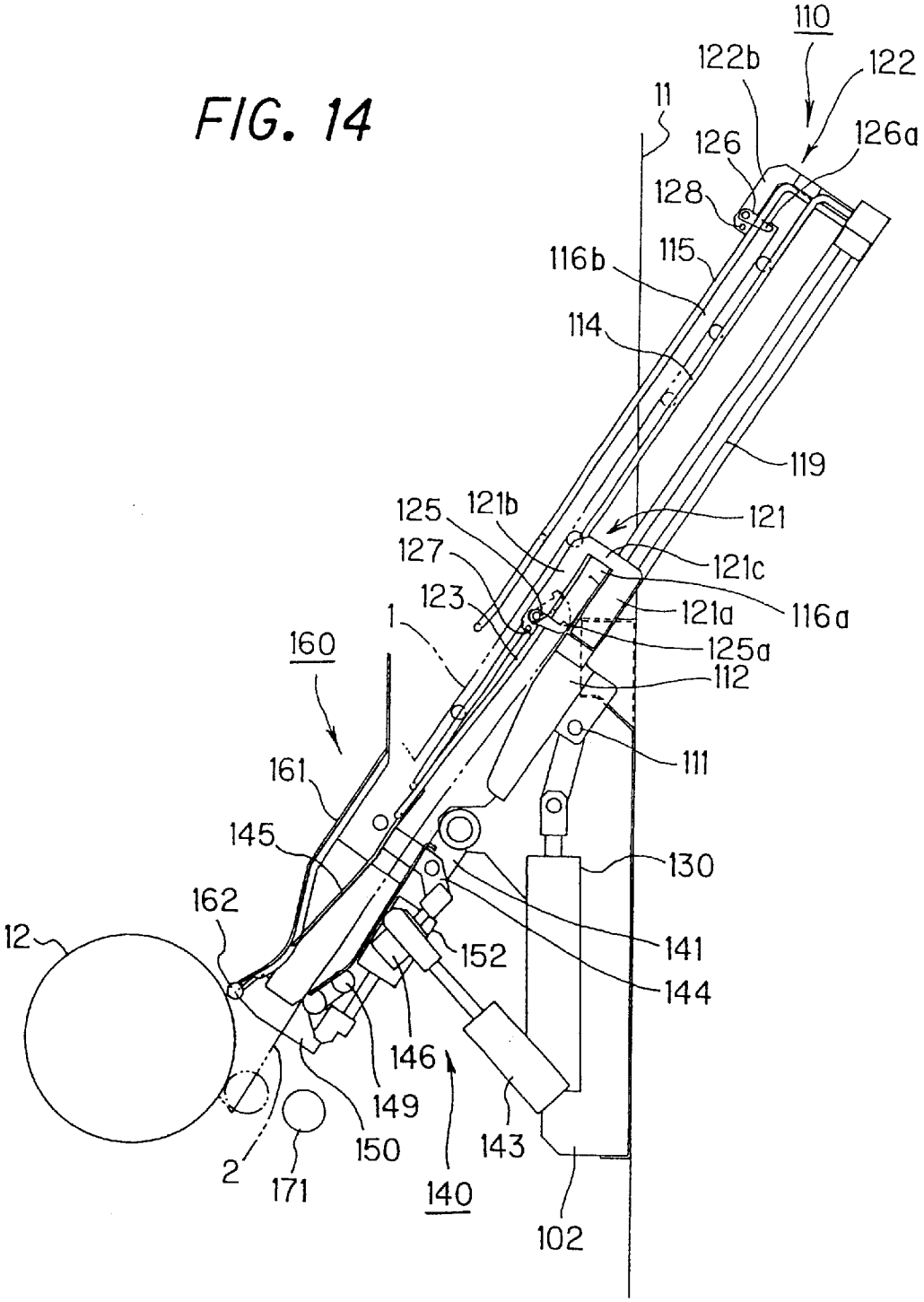
FIG. 14 shows a step for exchanging a printing plate in the upper printing plate exchange device.

That is, when the actuator 130 is extended, the supporting axis 111 is rotated via the link plate 129 to switch the upper printing plate holding device 110, including the guide frames 112, 113, between a released position (as shown in FIG. 2) and an operation position (as shown in FIG. 14) as described below. In the embodiment, moving means can be formed by the link plate 129, the actuator 130, and so on.

At a front end of the second guide portion 115, a hooking member 115*a*, as a release member, is outwardly protruded from the guide frame 113. At the guide member 114, between the guide frames 112, 113, a plurality of guide rollers 117, that rotate in the same rotational direction as the upper printing plate cylinder 12, are provided in the longitudinal direction of the guide frames 112, 113 and separated with a predetermined interval. At the guide frame 113, a contacting plate 118 for restricting the new printing plate 1 from sliding in a width direction is attached via a bracket (not shown).

At each outside surface of the confronting guide frames 112 (113), a rodless cylinder 119 (120) is attached such that an axial direction of the cylinder 119 (120) is arranged along the longitudinal direction of the guide frame 112 (113). A base end portion 121*a* of a U-shaped supporting member 121, of which an opening side is confronting a front edge of the guide frame 112, is attached to the rodless cylinder 119. The supporting member 121 can be slid along the longitudinal direction of the guide frame 112 between a position shown in FIG. 14, described below in detail, and a stored position shown in FIG. 15 by the rodless cylinder 119. A length of a connecting portion 121*c* is designed to position a height of a front end 121*b* of the supporting member 121 at the same level as an extending portion of the guide member 114.

Figure 15:
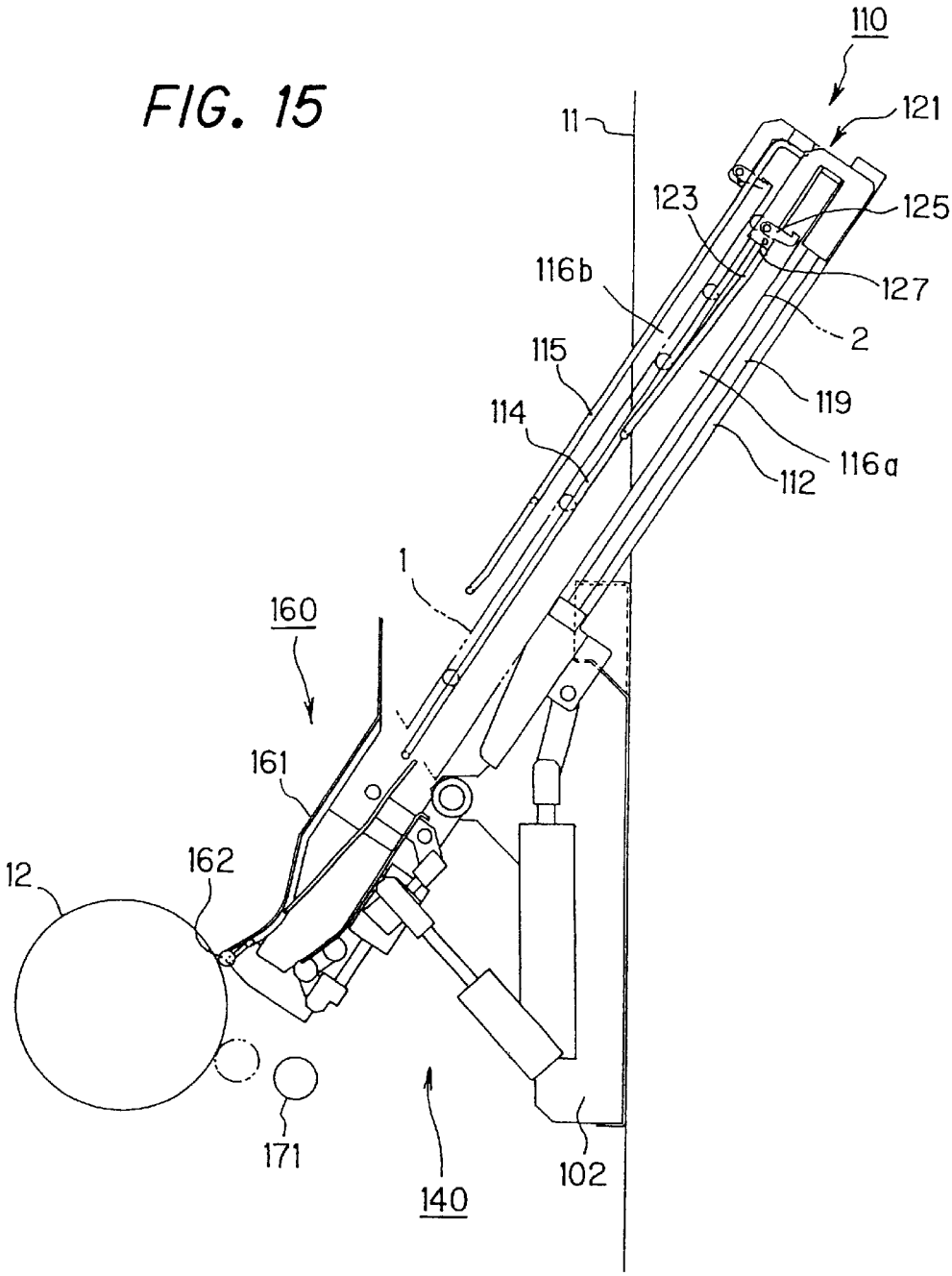
FIG. 15 shows a step following the step shown in FIG. 14.

At the front end 121*b* of the supporting member 121, a base end of the guide member 123 is connected and fixed, wherein a longitudinal direction is arranged along a longitudinal direction of the guide frame 112. At the front end 121*b* of the supporting member 121, a base end of the hook 125 with a claw portion 125*a* provided at a tip portion is affected as the discharged printing plate holding member and supported to rotate in the same rotational direction as the supporting axis 111. When the longitudinal direction as the front end portion 121*b* of the supporting member 121 is arranged toward a direction as shown in FIG. 15 as described below, the hook 125 is moved by its own weight to position the claw portion 125*a* at the base end portion 121*a* so that the claw portion 125*a* is advanced into the stored portion 116*a*. When the longitudinal direction of the front end portion 121*b* of the supporting member 121 is arranged in a vertical direction as shown in FIG. 2, the hook 125 is moved by its own weight to overlap the claw portion 125*a* on the front end portion 121*b* so that the claw proton 125*a* is retracted from the stored portion 116*a*.

Thus, the hook 125 is located closer to the front end of the guide frame 112 than the connecting portion 121*c* of the supporting member 121. In other words, when the hook 125 is located in the stored position, the hook 125 is positioned at an upper stream side with respect to the base end 114*a* located at a down stream end of the stored portion 116*a* in the discharged printing plate storing direction. A length between a pivotal point of the hook 125 and the base end portion 114*a* is longer than a length between the pivotal point of the hook 125 and the claw portion 125*a*. In other words, a length between the above pivotal point of the hook 125 in the stored position and an end portion of the storing portion 116*a* at a down stream side in the discharged printing plates storing direction is longer than a distance between the pivotal point and the front end portion of the hook 125.

A stopper pin 127 is protruded and mounted, as a pivot restricting member, at the front end portion 121*b* of the support member 121 near the base end of the hook 125. The stopper pin 127 limits pivotal movement of the hook 125 in order to avoid the claw portion 125*a* of the hook 125 from advancing from the stored portion 116*a* (see FIG. 15) toward the front end side of the guide member 123.

Figure 16:
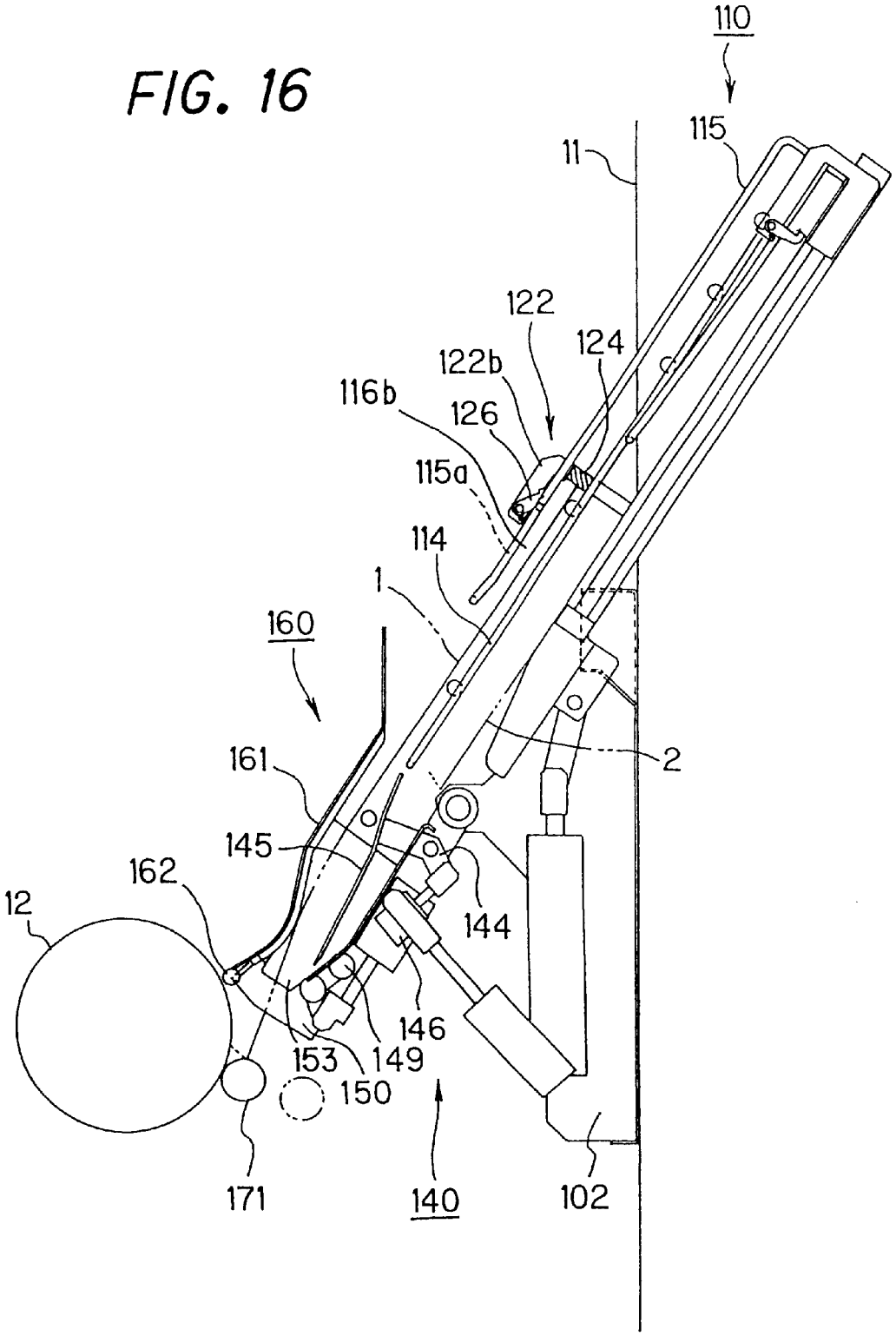
FIG. 16 shows a step following the step shown in FIG. 15.

On the other hand, the base end side 122*a* of the U-shaped support member 122, of which an opening portion faces the front end side of the guide frame 113, is provided at the rodless cylinder 120. The support member 122 can be slid between a stored position as shown in FIG. 15 and a position, as described in detail below and as shown in FIG. 16, by the rodless cylinder 120. A length of the connecting portion 122*c* is designed to position the front end portion 122*b* of the supporting member 122 slightly higher than the extending portion of the guide portion 115.

The hook 126, as a means for holding a new printing plate and having a claw portion 126*a* at the front end thereof, is pivotally supported by the front end 122*b* of the support member 122 such that it rotates in the same rotational direction as the support axis 111. When the longitudinal direction of the front end portion 122*b* of the supporting member 122 is in a direction as shown in FIG. 15, the claw portion 126*a* is moved to the base end 122*a* by its own weight to advance the claw portion 126*a* into the stored portion 116*b*. When the longitudinal direction of the front end portion 122*b* of the support member 122 is in the vertical direction as shown in FIG. 2, the claw portion 126*a* is moved by its own weight to overlap the front end portion 122*b* so that the claw portion 126 can retract from the stored portion 116*b*.

Thus, the hook 126 is located closer to the front end of the guided frame 113 than the connecting portion 122*c* of the supporting member 122. In other words, when the hook 126 is in the stored position, the hook 126 is positioned at the downstream side with respect to the base end 115*b* positioned at an upper stream side with respect to the stored portion 116*b* in a new printing plate supply direction. A length between a pivotal point of the hook 126 and the base end portion 115*b* is longer than a length between a pivotal point of the hook 126 and the claw portion 126*a*. In other words, a length between the pivotal point of the hook 126 in the stored position and an upper stream end of the stored portion 116*b* in the new printing plate supply direction is longer than a length of the pivotal point and the front end of the hook 126.

A stopper pin 128 is protruded and mounted, as a pivot restricting member, at the front end portion 122*b* of the support member 122 near the base end of the hook 126. The stopper pin 128 restricts pivotal movement of the hook 126 in order to avoid the claw portion 126*a* of the hook 126 from advancing from the stored portion 116*b* (see FIG. 15) toward the front end side of the guide member 115. A press plate 124, as a contacting member, is protruded at a portion between the guide portions 114 and 115 of the connecting portion 122*c* of the supporting member 122.

Upper First Printing Plate Guiding Device:

The upper printing plate exchange device 100 includes an upper first printing plate guiding device 140. As shown in FIG. 2, at an upper plate cylinder 12 side of the support frame, with respect to the supporting axis 111, each base end of a pair of pivot frames 141 of the upper first printing plate guide device 140 is connected and supported such that the pivot frames 141 pivots in the same direction as the rotational direction of the upper plate cylinder 12. The upper first printing plate guiding device 140 comprises the following components.

At the pivotal frame 141, a fixed guide plate 142 for guiding a movement of a discharged printing plate 2 is attached. A front end of an actuator 143 is pivotally connected to the pivotal frame 141. The base end of the actuator 143 is pivotally supported by the support frame 102. That is, the pivotal frame 141 can be rotated by extending/contracting the actuator 143 so that the pivotal frame 141 can be rotated between a guide position for guiding a new printing plate 1 and a discharged printing plate 2 adjacent the upper plate cylinder 12 (see in FIG. 14) and a shelter position (see FIG. 2) released from the upper plate cylinder 12.

A middle portion of a link plate 144 is pivotally connected to the pivotal frame 141. A guide plate 145, as a straddle guide, is attached to a front end of the link plate 144. A front end of the actuator 146 is connected to a base end of the link plate 144. A base end of the actuator 146 is pivotally supported by the pivotal frame 141.

That is, the guide plate 145 can be moved between a discharged printing plate guiding position (see FIG. 14) and a new printing plate guiding position (see FIG. 16) via a link plate by extending/contracting the actuator 146 (described in detail herein below).

At a front end of the pivot frame 141, a rotational axis 147 is pivotally supported such that it rotates in the same rotational direction as the upper plate cylinder 12. A base end of a support plate 148 is connected and fixed to the rotational axis 147. Guide rollers 149 are rotatably provided at a front end of the support plate 148. A U-shaped turning plate, of which a longitudinal direction is arranged in the axial direction of the upper plate cylinder 12, is connected to the rotational axis 147. One end of a connecting plate 151 is connected and fixed to the rotational axis 147. A front end of an actuator 152 is pivotally connected to the opposite end of the connecting plate 151. A base end of the actuator 152 is pivotally supported by the turning frame 141.

The rotational axis 147 is rotated via the connecting plate 151 by extending/contracting the actuator 152 so that the guide rollers 149 and the turning plate 150 can be moved.

A positioning plate 153 for adjusting a position of a printing plate along a width direction of the printing plate is attached to the pair of turning frames 141.

Upper Second Printing Plate Guiding Device:

The upper printing plate exchange device 100 includes an upper second printing plate guiding device 160. As shown in FIGS. 2, 5, and 6, the upper second printing plate guide device 160 is provided near the upper plate cylinder 12. The upper second printing plate guide device 160 comprises a guide plate 161 and a plurality of guiding rollers 162 pivotally provided at an end of the guide plate 161 at the side of the upper plate cylinder 12.

Upper Press Roller:

The upper printing plate exchange device 100 includes an upper press roller 171. As shown in FIG. 2, the upper press roller 171 is provided near the upper plate cylinder 12 in order to approach to and released from the upper plate cylinder 12.

Safety Cover:

The upper printing plate exchange device 100 includes a safety cover 103. As shown in FIGS. 2 and 3, a space between the frames 11 is covered by the safety cover 103 that at least partially partitions a portion between an internal portion and an external portion of the upper printing portion. The safety cover 103 is provided such that in a shelter position of the upper printing plate holding device 110 as shown in FIG. 2, the stored portions 116*a*, 116*b* of the upper printing plate holding device 110 are located at an exterior side with respect to the safety cover 103, and the guide frames 112, 113, the rodless cylinders 119 and 120, base end portions 121*a*, 122*a* of the support members 121, 122 and the upper first printing plate guide device 140, positioned at a left side with respect to the stored portion 116*a* of the upper printing plate holding device 110 as shown in FIG. 2 are located inside the safety cover 103. Therefore, a plurality of safety covers 103 are provided with spaces 103*a* therebetween such that the safety covers 103 are provided at portions corresponding to the guide frames 112, 113 of the upper printing plate holding device 110, the rodless cylinders 119, 120 and base end portions 121*a*, 122*a* of the supporting members 121, 122.

The safety cover 103 is pivotally supported by the frame 11 through support members such as the support arm 101, the support frame 102, and so on so that at least a part of the space formed between the pair of frames 11 can be shifted between a closed position for closing the space and an open position for opening the space. The upper printing plate holding device 110 is supported by the safety cover 103 through the support frame 102 such that it can rotate to the operation position (as shown in FIG. 14) relatively to the safety cover 103. Therefore, the upper printing plate holding device 110 can pivot even when the safety cover 103 is in the closed position.

The safety cover 103, provided between the left side guide frame 112 and the right side guide frame 113 of the upper printing plate holding device 110, is shorter than a longitudinal length of the guide frames 112, 113 so that the safety cover 103 can be turned with the maximum rotational radius smaller than the maximum rotational radius of the upper printing plate holding device 110.

Lower Printing Plate Exchange Device:

As shown in FIG. 1, a lower printing plate exchange device 200, as the printing plate changing device according to the present invention is provided near the lower plate cylinder 13. The lower printing plate exchange device 200 comprises the following components.

As shown in FIGS. 7 and 8, a supporting axis 201 is supported at the left- and right- frames 11, wherein an axial direction of the supporting axis 201 is arranged toward the axial direction of the lower plate cylinder 13. Base (upper) ends of the supporting frame 204 are pivotally connected to the both ends of the supporting axis 201, respectively.

Safety Cover:

The lower printing plate exchange device 200 includes a safety cover 203. The safety cover 203 having opening portions 203*a*, 203*b*, and a slit 203*c* is attached to the supporting frame 204. The safety cover 203 is pivotally supported by the frames 11 via the support axis 201 such that the safety cover moves between a close portion that covers at least a portion of a space formed between the pair of the frames 11 and an open position that opens the space.

The longitudinal length of the safety cover 203 is shorter than that of the guide frames 212, 213 of a lower printing plate holding device 210, such that the maximum turning radius of the safety cover 203 is shorter than the maximum turning radius of the lower printing plate holding device 210. In FIGS. 7 and 8, numeral 202 denotes a safety cover fixed at lower portions of the left side and right side of the frames 11, and numeral 202*a*~202*c* denote opening portions.

Lower Printing Plate Holding Device:

The lower printing plate exchange device 200 includes the lower printing plate holding device 210. A rotational axis 211 of the lower printing plate holding device 210 is connected to a base (upper) end portion between the supporting frames 204 such that it rotates in the same rotational direction as the lower plate cylinder 13. The lower printing plate holding device 210 has the following structure.

As shown in FIGS. 7 to 11, one end of each of a pair of a plate-shaped guide frames 212, 213 arranged along the axial direction of the lower plate cylinder 13, is connected and fixed to the opening portions 203*a*, 203*b* of the safety cover 203 of the rotational axis 211. In each slit 203*c* of the safety cover 203 of the rotational axis 211, a portion adjacent to one end of a plate-shaped support frame 217 is connected and fixed.

At the opposite end of the guide frame 212 (213), a base end of the guide member 214 (215), arranged in parallel with the longitudinal direction of the guide frame 212 (213) and extending toward one end of the guide frame 212 (213), is connected and fixed. The guide members 214, 215 are outwardly protruded from the opening portions 203*a*, 203*b* of the cover 203 to position the lower printing plate holding device 210 at an exterior side with respect to the safety cover 203 as shown in FIG. 7, and form a space therebetween in order to provide a stored portion 216*b* for storing the discharged printing plate 2. Further, a space is provided between the guide frames 212, 213 and the guide member 214 to provide a stored portion 216*a* for storing the new printing plate 1.

In the embodiment, means for storing a new printing plate can comprise the above described guide frames 212, 213 and the guide member 214, and means for storing a discharged printing plate can comprise the guide members 214, 215.

One end of the link plate 209 is connected and fixed to the rotational axis 211. On the opposite end of the link plate 209, the front end of the actuator 230 is pivotally connected. A base end of the actuator 230 is pivotally supported by the supporting member 205 attached to the support frame 204.

Figure 18:
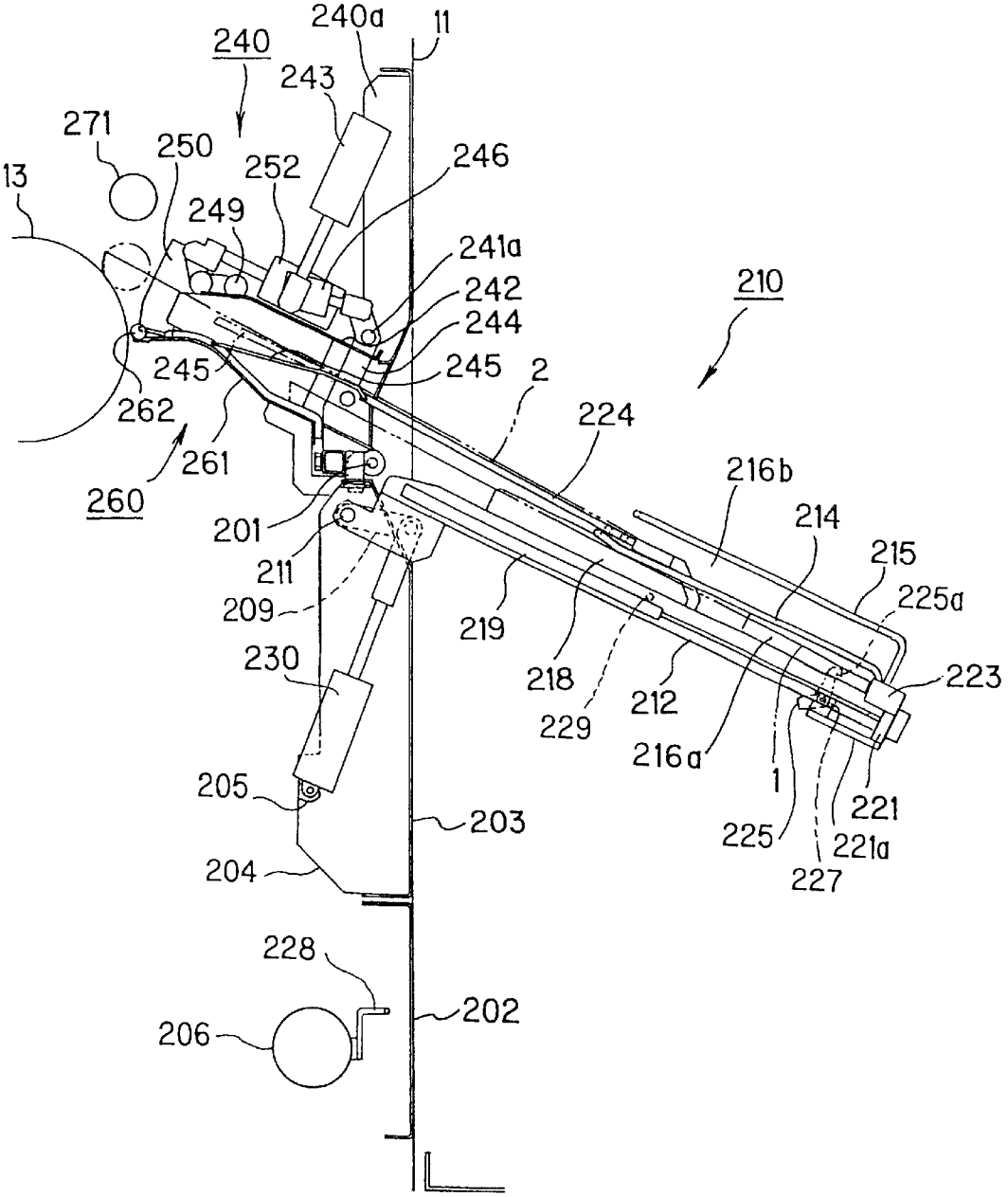
FIG. 18 shows an explanation of an operation of a lower printing plate change device.

The rotational axis 211 is rotated via the link plate 209 by extending and contracting the actuator 230 such that the lower printing plate holding device 210 comprising the guide frames 212, 213 and the support 217 can move between a shelter position (as shown in FIG. 7) and an operation position (as shown in FIG. 18) described in detail hereinafter. The link plate 209, the actuator 230, and components thereof constitute moving means in the present embodiment.

A contacting plate 218 for restricting the new printing plate sliding in the width direction thereof is attached to the guide frame 213 via a bracket. The actuators 219, 220 are attached to an exterior side of the guide frames 212, 213 with respect to a confronting surface of the guide frames 212 and 213, respectively, wherein the axial direction of the actuators 219, 220 is arranged along the longitudinal direction of the guide frames 212 and 213, respectively.

Figure 19:
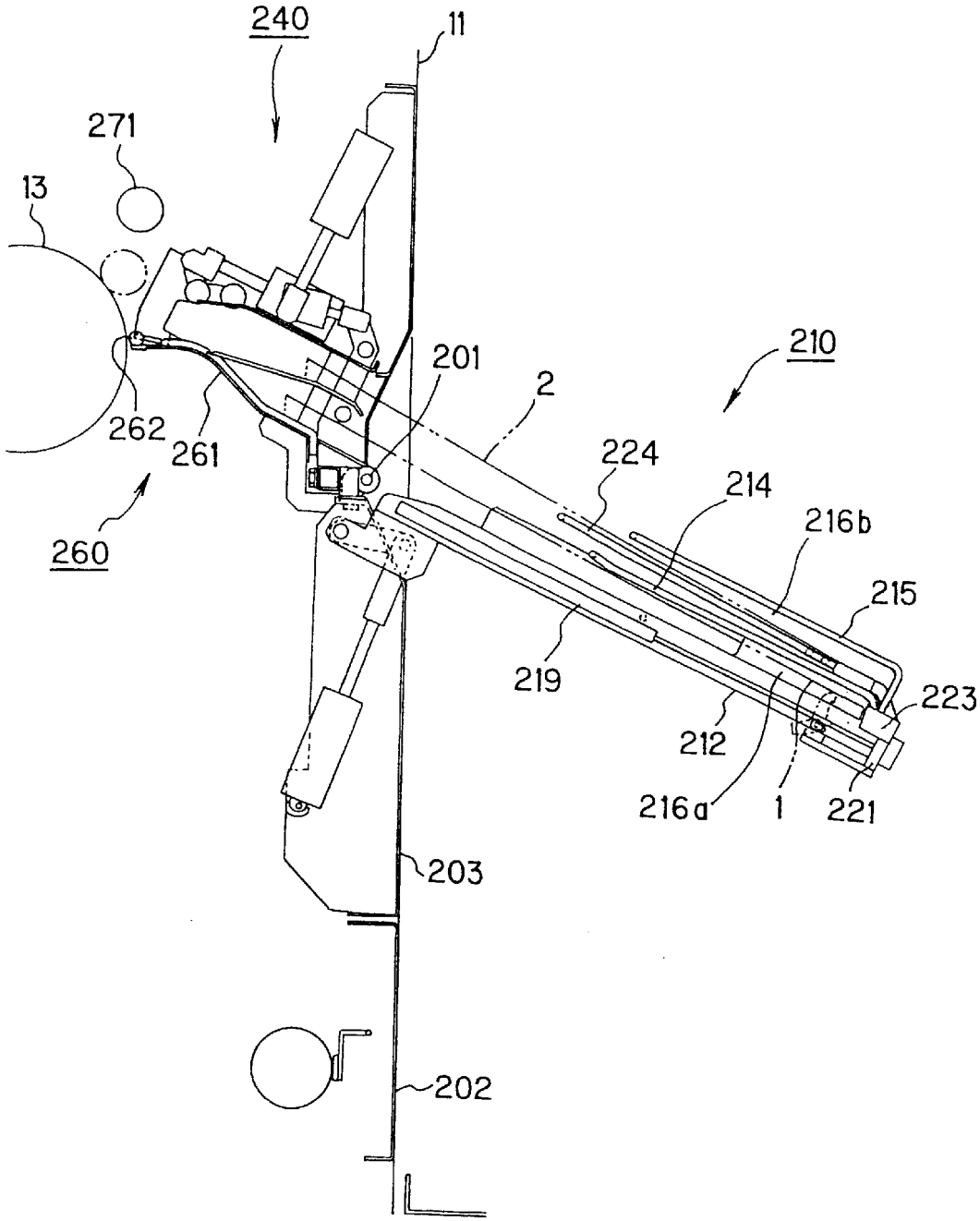
FIG. 19 is a step following the step shown in FIG. 18.
Figure 20:
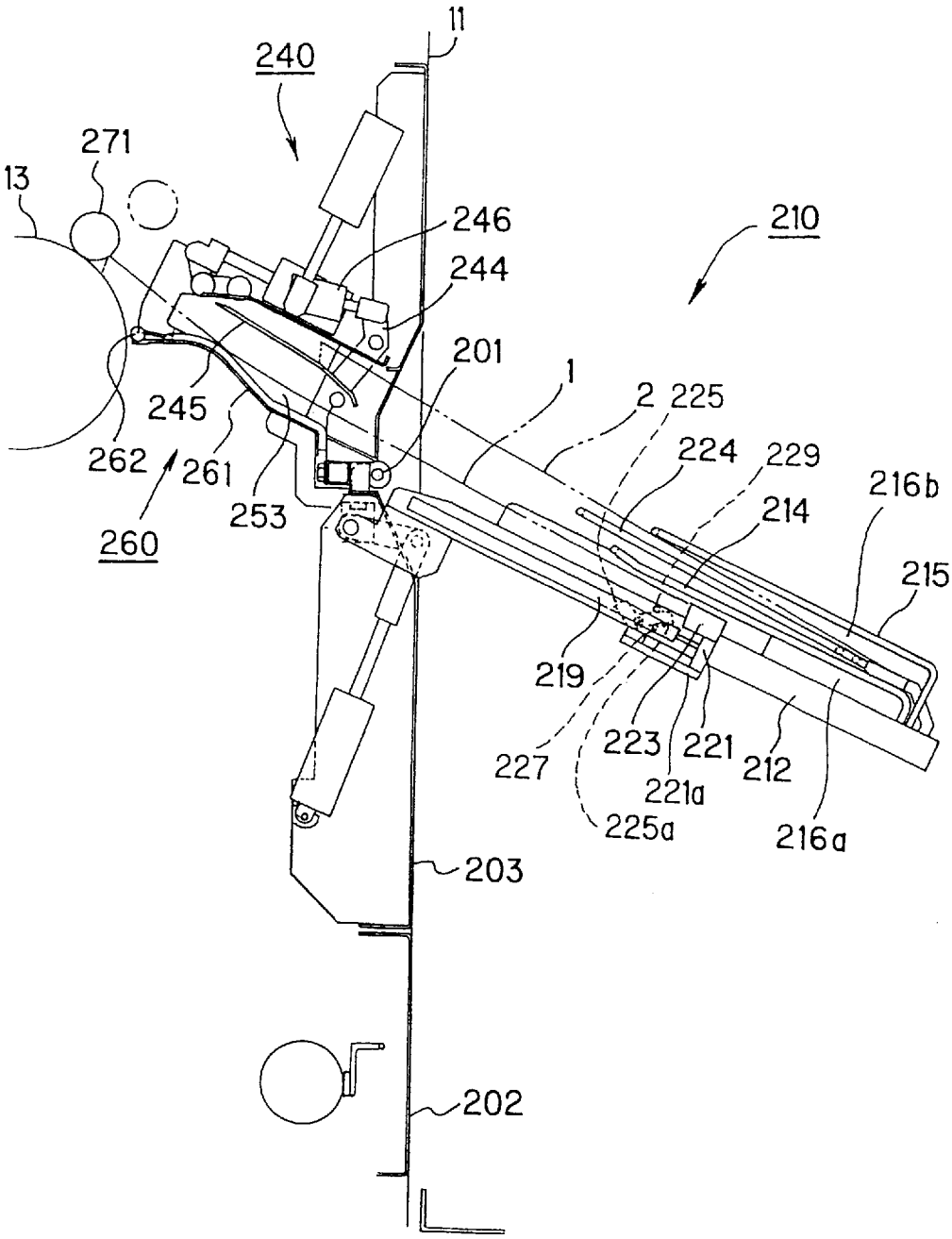
FIG. 20 is a step following the step shown in FIG. 19.

A support device 221, as a moving member of the present invention that moves between positions shown FIGS. 19, 20 by extending and contracting the rod of the actuator 219, is pivotally attached to a front end of a rod of the actuator 219. An extrusion member 223 for extruding a new printing plate 1 is attached to the supporting member 221. The extrusion member 223 is outwardly protruded from the opening portions 202*a*, 203*a* of the safety cover 202, 203 to position between the safety covers 202, 203 and the guide member 214 when the lower printing plate holding device 210 is positioned as shown in FIG. 7.

A bracket 221*a* extending toward a front end (at a side of the rotational axis 211) of the guide frame 212 is attached at the supporting member 221. A hook 225, as a new printing plate engagement member having a claw portion 225*a*, is connected at the bracket 221*a* to coaxially rotate about the axis of the rotational axis 211 in the same direction.

When the guide frame 212 is in the shelter position, the upstream side of the stored portion 216*a* with respect to the new printing plate supplement direction is positioned at the downstream side with respect to the new printing plate supplement direction. The hook 225 is located closer to the front end of the guide frame 212 than the extrusion member 223. In the other words, when the hook is in the stored position, the hook 225 is positioned at the downstream side rather than an end portion of the upstream side of the new printing plate of the stored portion 216*a* with respect to the new printing plate supply directions. A distance between a pivotal point of the hook 225 and an upper end of the hook 225 is longer than a distance between the pivotal point of the hook 225 and the claw portion 225*a*. In other words, a distance between the pivotal point at the storing position of the hook 225 and the upstream end portion of the stored portion 216*a* along the new printing plate supply direction is longer than a distance between the pivotal point of the hook 225 and the front end of the hook 225.

A spring 226, shown in FIGS. 9 and 10, is provided at the hook 225, as an energizing member for energizing the claw portion 225*a* of the hook 225 toward the stored portion 216*a*. A stopper pin 227 is provided at the bracket 221*a* in order to restrict a swing movement of the claw portion 225*a* of the hook 225 advanced at the stored portion 216*a* toward the rotational axis 211.

An extrusion pin 228, as a contacting member, is attached to a beam 206 connected between the frames 11. When the lower printing plate holding device 210 is located at a position shown in FIG. 7, the extrusion pin 228 makes contact with the base end of the hook 225 to release the claw portion 225*a* of the hook 225 from the stored portion 216*a* against the force urged by the spring 226. When a longitudinal direction of the guide frame 212 confronts a direction as described below and as shown in FIG. 18, the claw portion 225*a* of the hook 225 is advanced into the stored portion 216*a*. When the longitudinal direction of the guide frame 212 is faced toward a vertical direction as shown in FIG. 7, the claw portion 225*a* is released from the stored portion 216*a*.

In the embodiment, new printing plate releasing means can be formed of an actuator 219, a supporting member 221, the hook 225, and the spring 226.

At a middle portion of the guide frame 212 at a side confronting the guide frame 213 along the longitudinal direction, an engaging pin 229 is protruded as a new printing plate releasing member. When the actuator 219 is contracted, the engaging pin 229 retracts by making contact with the hook 225 in order to release the claw portion 225*a* of the hook 225 from the stored portion 216*a* against the force urged by the spring 226 (see FIG. 20).

At a front end of a rod of the actuator 220, as shown in FIG. 8, a supporting member 222, as a moving member according to the present invention, is provided movably between a position shown in FIG. 18 and a position shown in FIG. 19, as described below, by extending/contracting the rod of the actuator 220. A pick-up member 224 is attached to the supporting member 222 via the bracket 231, wherein the supporting member is a discharged printing plate engage member according to the present invention for moving the discharged printing plate 2 to the downstream side with respect to the discharged printing plate storing direction while the bent portion at a rear end of the discharged printing plate 2 is engaged. When the lower printing plate holding device 210 is located at a position as shown in FIG. 7, the pick-up member 224 is outwardly protruded toward the opening portion 202*b* (203*b*) of the safety cover 202 (203) to position between the guide members 214, 215.

Printing plate discharge means of the embodiment can be formed of an actuator 220, a supporting member 222, a pick-up member 224, and a bracket 231.

At a downstream side of the pick-up member 224 of the bracket 231 of the supporting member 222 with respect to the discharged printing plate storing direction, a receiving board 232, as a discharged printing plate movement restriction member according to the present invention, is attached in order to restrict a movement of the discharged printing plate 2 toward the downstream along the discharged printing plate storing direction.

Lower First Printing Plate Guiding Device:

The lower printing plate exchange device 200 includes a lower first printing plate guiding device 240. As shown in FIGS. 7 and 8, base ends of a pair of frames 240*a* of the lower first printing plate guide device 240 are pivotally connected and supported at an upper side of the supporting axis 201 to rotate in the same direction as the upper plate cylinder 13. The lower first printing plate guide device 240 comprises the following components.

A rotational axis 241*a*, of which the axial direction is arranged along the axial direction of the support axis 201, is attached to the frame 240*a*. To the rotational axis 241*a*, the base end of the pivot frame (not shown) and a middle portion of a link plate 244, as a straddle guide, are pivotally provided. A fixed guide plate 242 for feeding the discharged printing plate 2 is provided at the pivotal frame. A front end of the actuator 243 is pivotally connected to the pivot frame. A base end of the actuator 243 is pivotally supported by the body frame 240*a*.

The pivot frame is rotated by extending and contracting the actuator so that the guide plate 242 can be moved between a guide position near the lower plate cylinder and guiding the new printing plate 1 and the discharged printing plate 2 (see FIG. 18) and a shelter position released from the lower plate cylinder 13 (see FIG. 7).

A guide plate 245, as a straddle guide, is provided at a front end of the link plate 244. A front end of the actuator 246 is connected at a base end of the link plate 244. The base end of the actuator 246 is pivotally supported by the pivot frame.

The guide plate 245 can be moved between a position for guiding a discharged printing plate (see FIG. 18) and a position for guiding a new printing plate (see FIG. 20) via a link plate 244, by extending and contracting the actuator 246 (described in detail hereinafter). Discharged printing plate release means of the embodiment is formed of the link plate 244, the guide plate 245, and the actuator 246.

At the front end of the pivot frame, a rotational axis 247 that rotates in the same direction as the lower plate cylinder 13 is rotatably supported. A base end of the support plate 248 is connected and fixed to the rotational axis 247. A guide roller 249 is rotatably provided at a front end of the support plate 248.

A substantially U-shaped turning plate 250, of which a longitudinal direction thereof is arranged along an axial direction of the lower plate cylinder 13, is connected and supported by the rotational axis 247. One end of a connecting plate 251 is connected and fixed to the rotational axis 247. A front end of an actuator 252 is pivotally connected to the opposite end of the connecting plate 251. The base end of the actuator 252 is pivotally connected to the pivot frame.

Thus, the rotational axis 247 is rotated by extending and contracting the actuator 252 via the connecting plate 251 so that the guide roller 249 and the turning plate 250 can be moved.

Positioning plates 253 for positioning a plate along the width direction of the plate is provided at a pair of the pivot frames, respectively. A cover 254 is attached to the pivot frame.

Lower Second Printing Plate Guiding Device:

The lower printing plate exchange device 200 includes a lower second printing plate guiding device 260. As shown in FIGS. 7, 10 and 11, the lower second printing plate guiding device 260 is provided near the lower printing cylinder 13. The lower second printing plate guiding device 260 comprises a guide plate 261, as a guiding member according to the present invention, of which a base end is pivotally connected and supported by the support axis 201 to guide the discharged printing plate 2 discharged from the lower printing cylinder 13, and a plurality of guiding rollers 262 rotatably provided at the end of the lower printing cylinder side (front end) of the guide plate 261. The lower second printing plate guiding device 260 can be moved between a guiding position for guiding a new printing plate 1 supplied to the lower printing cylinder 13 and a discharged printing plate discharged from the printing cylinder 13, and a shelter position located far from the lower printing cylinder 13.

Lower Press Roller:

The lower printing plate exchange device 200 includes a lower press roller 271. As shown in FIG. 7, the lower press roller 271 is provided near the lower plate cylinder 13 to approach to and be released from the lower plate cylinder 13.

In a shelter position of the lower printing plate holding device 210 as shown in FIG. 7, the safety cover 202 (203) is located at the stored portions 216*a* (216*b*) of the lower printing plate holding device 210 at an exterior side with respect to the safety covers 202 (203). In order to position the guide frame 212 (213), the supporting frame 217, the actuator 219 (220), the base portion of the supporting member 221 (222) which are located at the left side with respect to the stored portion 216*a* of the lower printing plate holding device as shown in FIG. 7 at an interior side of the safety cover 202 (203), the opening portion 202*a* (202*b*, 203*a*, 203*b*) and the slit 203*c* are provided corresponding to the guide frame 212 (213), the supporting frame 217, the actuator 219 (220), and the base end of the supporting member 221 (222) of the lower printing plate holding device 210.

Figure 17:
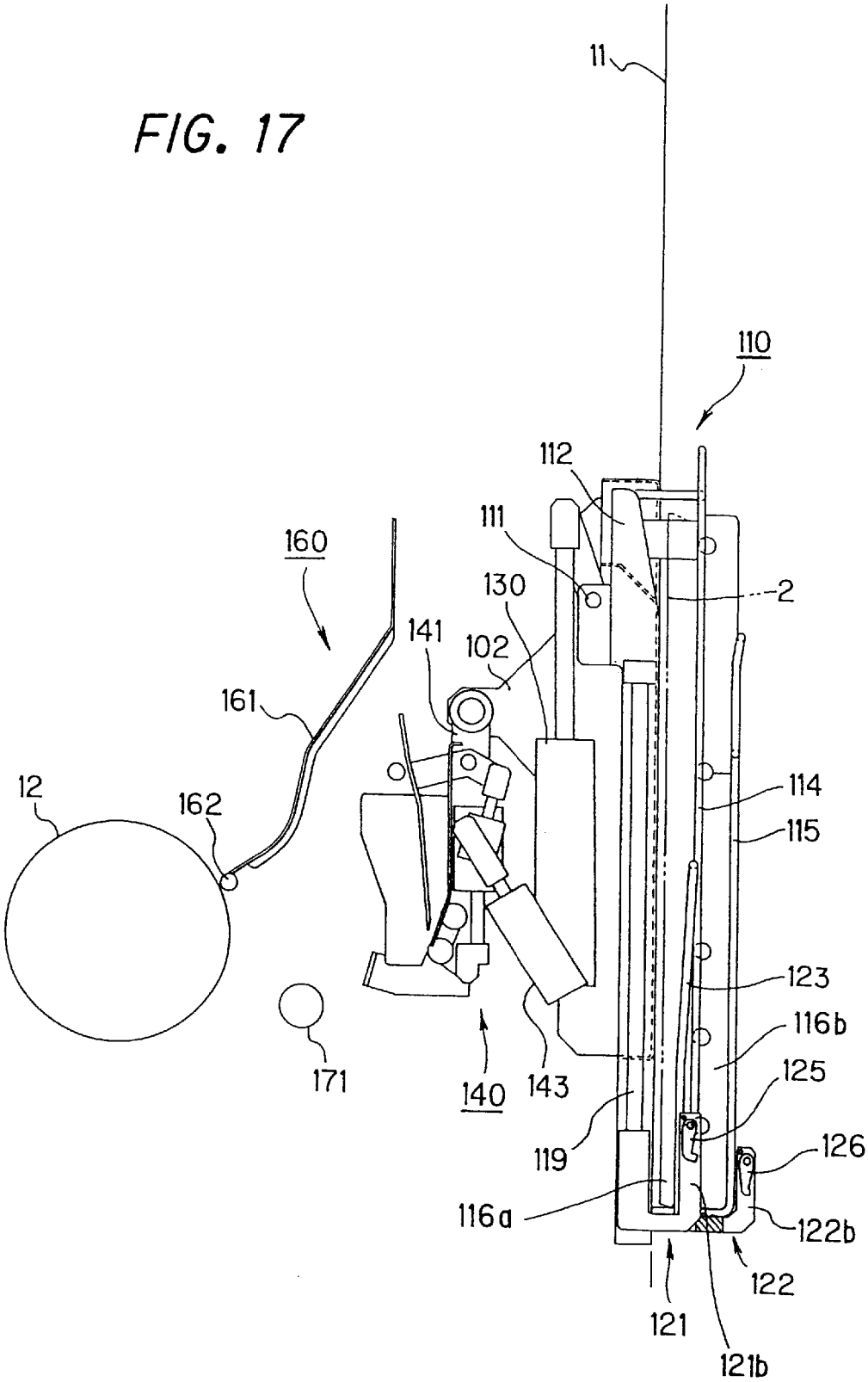
FIG. 17 shows a step following the step shown in FIG. 16.
Figure 21:
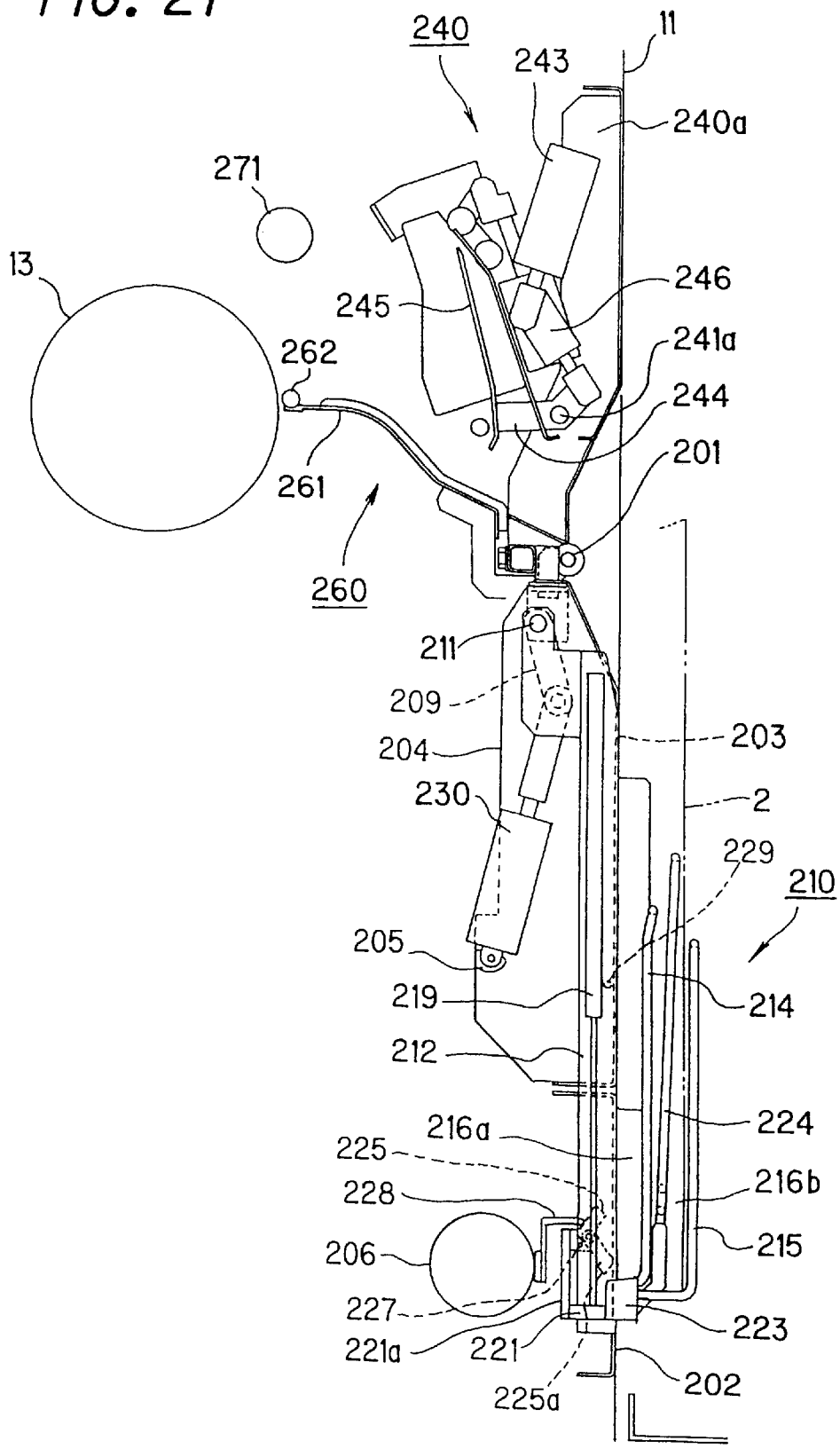
FIG. 21 is a step following the step shown in FIG. 20.

Operation of Printing Plate Changing Device:

An operation for exchanging printing plates in the upper printing plate exchange device 100 and the lower printing plate exchange device 200 is explained with reference to FIG. 14 to FIG. 21. FIG. 14 shows a first step of exchanging printing plates in the upper printing plate exchange device. FIG. 15 shows the step that follows the step shown in FIG. 14. FIG. 16 shows the step following the step shown in FIG. 15. FIG. 17 shows the step following the step shown in FIG. 16. FIG. 18 shows the step of explaining the lower printing plate change device. FIG. 19 shows the step following the step shown in FIG. 18. FIG. 20 shows the step following the step shown in FIG. 19. FIG. 21 shows the step that follows the step shown in FIG. 20.

Operation of Upper Printing Plate Exchange Device:

FIGS. 2 and 3 generally show the upper printing plate exchange device and can be relied on when elements discussed hereinbelow are not found in other figures.

Shift to an Operation Position:

During a printing operation, as shown in FIG. 2, the upper printing plate holding device 110 is located in the shelter position by arranging the guide frames 112, 113 and guide members 114, 115 in a vertical direction. A downstream side of the stored portion 116*a* is lower than the upstream side of the stored portion 116*a* in the discharge printing plate storing direction. The upstream side of the stored portion is lower than the downstream side of the stored portion in the new printing plate supply direction.

Under the above condition, a printing plate 1, of which a tail end is arranged at a lower side, is inserted into the stored portion 116*b* between the guide members 114, 115 of the upper printing plate holding device 110 with the contacting plate 118 to store the new printing plate 1 at the stored position.

At that time, a longitudinal direction of the front end portions 121*b*, 122*b* of the support members 121, 122 of the upper printing plate holding device 110 are positioned toward a vertical direction, the hooks 125 , 126 are removed from the stored portions 116*a*, 116*b* by the dead weight to overlap the front end portions 121*b*, 122*b* of the support members 121, 122. The stored portion 116*b* is positioned at an exterior side with respect to the safety cover 103. A shelter position is located under the upper printing portion, and the downstream side of the stored portion 116*b* is lower than the downstream of the stored portion 116*b* at the operating position in the printing plate supply direction, so that an operation for the stored portion 116*b* at the shelter position can be done at the exterior and lower side with respect to the safety cover 103. Thus, the new printing plate can be very simply set in the stored portion 116*b*.

Since almost all members except for the members related to the stored portions 116*a*, 116*b* of the upper printing plate holding device 110 are stored at an interior side with respect to the safety cover 103, an outwardly protruded amount from the safety cover 103 is small. Therefore, an operation space can be utilized effectively to change the printing plates conveniently.

When the actuator 130 is contracted, as shown in FIG. 14, the upper printing plate holding device 110 is moved to an operation position by turning the guide frames 112, 113 about the rotational axis 111 to arrange the front end of the guide members 114, 115 toward the upper plate cylinder 12.

A downstream side of the stored portion 116*a* is located higher than an upstream side of the stored portion 116*a* in a discharged printing plate storing direction and upstream side of the stored portion 116*b*, with respect to the new printing plate supplying direction, is located higher than the downstream said thereof. That is, an opening portion of the support members 121, 122 are downwardly inclined. The hooks 125, 126 are moved to advance the claw portions 125*a*, 126*a* into the stored portions 116*a*, 116*b*. Under this condition, the stopper pins 127, 128 restrict movement of the claw portions 125*a*,126*a* so that the claw portion 126*a* of the hook 126 can engage a tail end of the new printing plate to prevent the new printing plate from falling.

Simultaneously, the support member 121 is moved from a position as shown in FIG. 2 to a front end of the guide frame 112 (upstream side in the discharged printing plate storing direction) as shown in FIG. 14 by actuating the rodless cylinder 119 of the upper printing plate holding device 110. The guiding device 140 is moved to a guiding position by rotating the pivot frame 141 by extending the actuator 143 of the upper first printing plate change device 140, then the guide plate 145 for guiding the discharged printing plate 2 discharged from the upper plate cylinder 12 to the stored portion 116*a* of the upper printing plate holding device 110 by rotating the link plate 144 by contracting the actuator 146.

Storing a Discharged Printing Plate:

Next, by moving the press roller 171 to the operation position, rotating the upper printing plate cylinder 12 while pressing the roller 171 against the upper printing plate cylinder 12, and disengaging the tail end of the printing plates engaged by means for holding the end of the printing plate of the upper plate cylinder 12, the tail end of the discharged printing plate 2 is moved out from the upper plate cylinder 12. Then, the discharged printing plate 2 is guided between the guide plates 142, 145 of the upper first printing plate guiding device 140 and fed to the stored portion 116*a* between the guide frames 112,113 and the guide member 123 of the upper printing plate holding device 110 by forwarding the tail end. The hook 125 is pivotally supported so that the hook 125 is rotated by the tail end of the discharged printing plate 2 while the tail end is being fed. After the tail end of the discharged printing plate 2 is passed through the hook 125, the hook 125 returns to an initial position (as shown in FIG. 14) by gravity force.

A disengagement of holding the tail end of the printing plate, by the means for holding the edge of the printing plate, is operated at an upstream point with respect to the inverse rotating direction, closer than the edge confronting with the upper plate cylinder 12 of the guide plate 161.

By inversely rotating the upper plate cylinder 12, an engaged side of the discharged printing plate 2 approaches the upper first printing plate guiding device 140. Then, the means for holding the edge of the printing plate disengages the engaged tail end of the printing plate, the press roller 171 is moved to the shelter position to be released from the upper plate cylinder 12, and the actuator 152 of the upper first printing plate guiding device 140 is shortened. Thereby, the guide roller 149 and the swing plate 150 rotate in a counter clockwise direction about the rotational axis 147 as shown in FIG. 14. The swing plate 150 moves the engaged end of the discharged printing plate 2 toward an outward radius direction of the upper plate cylinder 12 so that the discharged printing plate 2 can be reliably released from the upper plate cylinder 12.

After the discharged printing plate 2 is completely released from the upper plate cylinder 12, the guide roller 149 and the swing plate 150 are returned to the shelter position by extending the actuator of the first printing press guiding device 140. As shown in FIG. 15, the rodless cylinder 119 of the upper printing plate holding device 110 is operated to return the support member 121 toward the base end of the guide frame 112 (downstream of the discharged printing plate storing direction), the claw 125*a* of the hook 125 engages the tail end of the discharged printing plate 2. According to such a movement, the discharged printing plate 2 is begun to be picked up by the claw portion 125 a of the hook 125 engaging with the rear end of the discharged printing plate 2.

At that time, the guide plate 145 releases a gripped side of the discharged printing plate 2 from a guide plate 161 of the upper second guiding device 160 so that the gripped side of the discharged printing plate 2 can be prevented from being bumping against the end (front end) portion of the upper plate cylinder 12 of the guide plate 161. When the gripped side of the discharged printing plate 2 is passed over the front end of the guide plate 161 of the upper second printing plate guide device 160, the guide plate 145 is returned to the discharged printing plate guiding position by contracting the actuator 146 of the upper first printing plate guiding device. Continuously, the claw portion 125*a* of the hook 125 is moved to the stored position of the storing portion 116*a* between the guide frames 112, 113 and the guiding member 123.

The hook 125 is restricted from swinging toward the upstream with respect to the discharged printing plate storing direction by the stopper pin 128 so that the discharged printing plate 2 can be picked up reliably. In accordance with the movement of the rodless cylinder 119, the supporting member 121, the hook 125 and so on, the gripped side of the discharged printing plate 2 can be easily released from the upper end of. the guide plate 161 by rolling the guide roller 162 even if the gripped bent portion of the discharged printing plate 2 released from the upper plate cylinder 12, is caught by the end portion of the upper plate cylinder 12 of the guide plate 161 of the upper second printing plate guiding device 160.

Attaching a New Printing Plate:

As shown in FIG. 16, the link plate 144 is rotated by extending the actuator 146 of the upper first printing plate guiding device 140 to move the guide plate 145 to the new printing plate guide position for supplying the new printing plate 1, held in the stored portion 116*b* of the upper printing plate holding device 110, to the upper plate cylinder 12, and to move the press roller 171 at an operation position to press the press roller 171 against the upper plate cylinder 12. Thus, the support member 122 is moved from the stored position of the stored portion 116*a* to the front end of the guide frame 113 (downstream in the new printing plate supply direction), the press plate 124 makes contact with the tail end of the new printing plate 1, and the new printing plate 1 is fed toward the upper plate cylinder 12 (downstream in the new printing plate supply direction).

As described above, the support member 122 is moved toward the front end of the guide frame 113 to feed the new printing plate 1 toward the upper printing cylinder 12, the hook 126 is caught and contacted with a catching portion 115*a* of the guide member 115 on the way to move the hook 126 away from the stored portion 116*b*. The tail end of the new printing plate 1 is unlocked from the hook 126 so that the new printing plate 1 is fed while being precisely positioned in the width direction of the new printing plate 1 by the. left and right positioning plates 153 of the supper first printing plate guiding device 140 and stopped when the engaged end makes contact with the press roller 171.

Then, when the upper plate cylinder 12 is rotated in the forward direction, the front end of the bent portion at the gripped side of the new printing plate 1 is pushed against a peripheral surface of the plate cylinder 12 by the press roller 171. in the peripheral surface of the plate cylinder 12. When the gap provided at the plate cylinder 12 and the front end of the bent portion of the gripped side of the new printing plate 1 are confronted, the front end of the bent portion at the gripped side of the new printed plate 1 is inserted into the gap of the plate cylinder by the press roller 171. By further rotating the plate cylinder 12 in the forward direction, the new printed plate 1 is wound on the plate cylinder 12 and attached thereto.

Even if the safety cover 103 is not opened, the upper printing plate holding device 110 can be moved from the shelter position to an operation position so that it can prevent tools from being dropped into an inside of the printing portion while the printing plate change is operated.

Returning the New Printing Plate in the Case of an Improper Attachment:

In the case when an abnormality occurs, such as the new printing plate 1 does not wind around the upper plate cylinder 12, while the new printing plate 1 is being attached to the upper plate cylinder 12, the printing press is stopped by the control device. Upon occurrence of an abnormality, sensors detect that the rear end of the new printing plate 1 is still present close to the hook 126 when the upper plate cylinder is forwardly rotated to a predetermined position. With respect to a printing unit at which the front end at a gripped side of the new printing plate 1 is not attached to the upper plate cylinder 12, the rodless cylinder 120 is operated by moving the supporting member 122 of the upper printing plate holding device 110 of the printing unit from the front end (downstream side along the new printing plate supply direction) of the guide frame 113 to the storing position of the storing portion 116*b*.

Upon detection of abnormality in attaching the new printing plate 1, wherein the front end at the gripped side of the new printing plate 1 is attached at the upper plate cylinder 12, the new printing plate 1 is discharged by backwardly rotating the upper plate cylinder 12 of the printing unit. The press roller 171 is moved to the shelter position to be released from the upper plate cylinder 12 in the case that the bent portion at the gripped side of the new printing plate 1 attached at the upper plate cylinder is positioned near the press roller 171 contacting with the upper plate cylinder 12. By contracting the actuator 152 of the upper first printing plate guiding device 140, the guide roller 149 and the swing plate 150 are rotated about a rotational axis 147 in a counter clockwise direction at a view point of a front side in FIG. 14 so that the gripped side of the new printing plate 1 is maintained in a released condition with respect to the upper plate cylinder 12 by the swing plate 150.

Next, the hook 126 is released from the hooked portion 115*a* of the guide member 115, and the claw portion 126*a* is rotated to be advanced into the stored portion 116*b*. The claw portion 126*a* of the hook 126 is engaged with the rear end of the new printing plate 1. In accordance with the movement of the rodless cylinder 120, the new printing plate 1 is returned into the stored portion 116*b* so that the gripped end of the new printing plate 1 can be prevented from being damaged.

Switch to the Shelter Position:

After discharging of the new printing plate 1, as described above, has completed the pivot frame 141 is rotated by contracting the actuator 143 of the upper first printing plate guiding device 140 as shown in FIG. 17 to move the guide device 140 to the shelter position. The support member 122 is then moved toward the base end of the guide frame 113 by actuating the rodless cylinder 120 of the upper printing plate holding device 110, and the guide frames 112,113 are rotated by extending the actuator 130 to move the printing plate holding device 110 to the shelter position. Then, the guide frames 112,113 and the guide members 114,115 are rotated wherein the longitudinal direction thereof is arranged along an up and down direction. A downstream of the stored portion 116*a* is located lower than the upstream of the stored portion 116*a* in the discharged printing plate store direction. The upstream of the stored portion 116*b* is located lower than the downstream of the stored portion 116*b* in the new printing plate supply direction.

The longitudinal direction of the front ends 121*b*, 122*b* of the support members 121, 122 of the upper printing plate holding device 110 is arranged in the vertical direction, such that the hooks 125,126 are rotated by their own weight to go out from the stored portions 116*a*, 116*b* and overlaps the front ends 121*b*, 122*b* of the support members 121, 122, respectively. Further, the stored portion 116*a* is located at an exterior side with respect to the safety cover 103, and the safety cover 103 is positioned at a back side of the stored discharged printing plate 2 to form a guide surface. The shelter position is located under the upper printing portion and a position at the downstream of the stored portion 116*b*, in the discharged printing plate storing direction. The shelter position is lower than the operation position so that an operation of the stored portion 116*a* in the shelter position can be worked at the lower position at the exterior side of the safety cover 103 protruded from the safety cover 103. The discharged printing plate 2 can be removed from the stored portion 116*a* at the opposite side of the contacting plate 118, and the discharged printing plate 2 can be removed from the stored portion 116*a* without an operator entering into adjacent printing units.

Almost all members of the upper printing holding device 110 expect for the members related to the stored portions 116*a* and 116*b* are stored at an interior side with respect to the safety cover 103, so that an outwardly protruded amount of the safety cover 103 is small. Thus, a working space can be utilized effectively and a printing plate exchange operation can be improved more conveniently.

Operation of Lower Printing Plate Exchange Device:

FIGS. 7 and 8 generally show the lower printing plate exchange device and can be relied on when elements discussed hereinbelow are not found in other figures.

Shift to the Operation Position:

During printing, as shown in FIG. 7, the guide frames 212, 213 and the guide members 214, 215 of the lower printing plate holding device 210 are arranged along the up and down direction to position the stored portions 216*a* and 216*b* at the shelter position which is at an exterior side with respect to the safety cover 203.

Under the above condition, the tail end of the new printing plate is positioned at the lower side and inserted into the stored position of the stored portion 216*a* of the lower printing plate holding device by contacting the new printing plate 1 with the contacting plate 218.

The stored portion 216*a* of the lower printing plate holding device 210 is located at the exterior side with respect to the safety cover 203, and the safety cover 203 is arranged along the stored portion 216*a* so that an operation for setting the new printing plate 1 with respect to the stored portion 2116*a* at the shelter position can be worked at the exterior side of the safety cover 203 with the safety cover 203 functioning as a guide surface.

Since almost all members of the lower printing plate holding device 210 except for the members related to the stored portions 216*a*, 216*b* are located at an interior side with respect to the safety cover 203, an outwardly protruded volume is small. Thus, working space can be utilized effectively and a printing plate exchange operation can be improved.

Next, when the actuator 230 is extended, as shown in FIG. 18, the guide frames 212, 213 and the support frame 217 are rotated about the rotational axis 211 to arrange the front end of the guide members 214, 215 toward the lower plate cylinder 13. Then, the lower printing plate holding device 210 is shifted to the operation position. At that time, the hook 225 is released from the push pin 228, the hook 225 is rotated to advance the claw portion 225*a* into the stored portion 216*a* by the force urged by the spring 226, and stopped at a stop position by the stopper position.

Simultaneously, the pick-up member 224 is moved from the position shown in FIG. 7 to a front end of the guide frame 213 as shown in FIG. 18 by contracting the actuator 220 of the lower printing plate holding device 210. The pivot frame is rotated by extending the actuator 243 of the lower first printing plate guiding device 240 to move the lower first printing plate guiding device 240 at the guiding position. Thus, the link plate 244 is rotated by shortening the actuator 246 to move the guide plate 245 to a discharged printing plate guide position for guiding a discharged printing plate 2 discharged from the lower plate cylinder to the stored portion 216*b* of the lower printing plate holding device 210.

Storing a Discharged Printing Plate:

The press roller 271 is shifted to the operation position, and rotates the lower plate cylinder 13 in an inverse direction while pressing the press roller 271 against the lower plate cylinder 13, and the engagement of the tail end of the printing plate 2 with the means for holding the edge of the printing plate of the lower plate cylinder 13 is released. Thus, the tail end of the discharged printing plate 2 projects from the lower plate cylinder 13, and the discharged printing plate 2 is guided between the guide plates 242, 245 of the lower first printing plate guide device 240. The discharged printing plate 2 is fed on the pick-up member 224 of the stored portion 216*b* between the guide frames 214, 215 of the lower printing plate holding device 210 from the tail end.

In some cases, the rear end of the discharged printing plate 2 bumps against the front end of the guide plate 261 of the lower second printing plate guiding device 260. However, the discharged printing plate 2 can be fed out without the rear end of the discharged printing plate 2 being caught by the front end of the guide plate 261 since the guide rollers 262 are provided at the front end of the guide plate 261.

Releasing of the rear end of the discharged printing plate held by the means for holding the end portion of the printed plate is operated at the upstream of the lower plate cylinder 13 with respect to the reverse rotational direction as compared to the end portion confronting with the lower plate cylinder 13 of the guide plate 261.

While the plate cylinder 13 is rotated in the inverse direction, the engaged side of the discharged printing plate 2 approaches the lower first printing plate guiding device 240. Then, the engagement of the engaged end of the printing plate by the means for holding the edge of the printing plate is disengaged and the press roller 271 is shifted to the shelter position to be removed from the lower plate cylinder 13, and the actuator 252 of the lower first printing plate guiding device 240 is contracted. Thereby, the guide roller 249 and the swing plate 250 rotate in a counter clockwise direction about the rotational axis 247 as shown in FIG. 18, the swing plate 250 feeds the engaged end of the discharged printing plate 2 toward an outward radius direction of the lower plate cylinder 13 so that the bent engaged end of the discharged printing plate 2 can be reliably disengaged.

When discharged printing plate 2 is completely released from the lower plate cylinder, the actuator 252 of the lower first printing plate guiding device 240 is extended to return the guide roller 249 and the swing plate 250 to the shelter position. When the guide plate 245 is once moved to the new printing plate guide position by extending the actuator 246, the gripped end of the discharged printing plate 2 is lifted upwardly and released from the guide plate 261 of the lower second printing plate guiding device 260 so that the printing plate can be prevented from bumping into the end at the lower plate cylinder 13 (front end) of the guide plate 261.

At that time, the discharged printing plate 2 is not held with respect to the discharged printing plate storing direction. Therefore, under certain circumstances, the gripped end may bump into the front end of the guide plate 261 since the discharged printing plate 2 is moved toward the downstream side along the discharged printing plate storing direction under the gravity force before the discharged printing plate is picked up by the guide plate 245. However, the receiving board 232 is provided at the lower printing plate holding device 210. Even if the discharged printing plate is moved toward the downstream side with respect to the discharged printing plate storing direction under the gravity force, the movement of the discharged printing plate 2 is restricted by being received by the receiving board 232. Thus, the gripped end is reliably prevented from crashing into the front end of the guide plate 261.

Then, a receiving member 224 is returned to a base end of the guide frame 213 by operating the actuator 220 of the lower printing plate 210. The receiving member 224 is engaged with the rear end of the discharged printing plate 2 and the discharged printing plate 2 begins to move towards the discharged printing plate storing direction. When the gripped end of the discharged printing plate 2 passes over the guide plate 261 of the lower second printing plate guiding device 260, the guide plate 245 is returned to the discharged printing plate guide position by contracting the actuator 246 of the lower first printing plate guiding device 240. Then, the actuator 220 is operated, as shown in FIG. 19, and the discharged printing plate 2 is stored in the stored position of the storing portion 216*b* above the receiving member 224 between the guide members 214, 215.

Attachment of the New Printing Plate:

As shown in FIG. 20, the link plate 244 is rotated by extending the actuator 246 of the lower first printing plate guide device 240 to move the guide plate 245 to the new printing plate guide device for supplying the new printing plate 1 held in the stored portion 216*a* of the lower printing plate holding device 210 to the lower plate cylinder 12. The press roller 271 is shifted to the operation position to press it against the lower plate cylinder 13. The extrusion member 223 is moved to the front end of the guide frame 212 by contracting the actuator 219 of the lower printing plate holding device 210, and the tail end of the new printing plate 1 is pushed by the pushing member 223 and fed toward the lower printing plate cylinder 13 while the width direction of the new printing plate 1 is accurately adjusted by the left- and right- positioning plates 253.

When the engaged end of the new printing plate 1 makes contact with the press roller 271, the feeding operation is stopped. At that time, the hook 225 makes contact with the engaging pin 229 and further rotates against the force urged by the spring 226. Thus, the claw portion 225*a* of the hook 225 is released from the storing portion 216*a*.

Next, when the lower plate cylinder 13 is rotated in the forward direction, a press roller 271, contacting with a peripheral surface of the plate cylinder 13, is also rotated to push the front end of the bent portion at the gripped side of the new printing plate 13 on the peripheral surface of the plate cylinder 13. When the gap provided at the plate cylinder 13 and the front end of the bent portion at the gripped end of the new printing plate 1 opposes, the front end of the bent portion at the gripped end of the new printing plate 1 is inserted into the gap by the press roller 271. By further rotating the plate cylinder 13 in the forward direction, the new printing plate 1 can be wound on the plate cylinder 13.

At that time, although the safety cover 203 is not released, the lower printing plate holding device 210 can be shifted from the shelter position to the operation position so that tools can be prevented from falling into an internal portion of the printing portion during a printing plate exchange operation.

Returning of New Printing Plate When Attachment is Abnormal:

In the case when an abnormality occurs while the new printing plate 1 is being attached to the lower plate cylinder 13, such as the new printing plate 1 does not wind around the lower plate cylinder 13, the printing press is stopped by the control device. Upon occurrence of an abnormality, the lower plate cylinder 13 is forwardly rotated to the predetermined position, and sensors detect that the rear end of the new printing plate 1 is still located at a position near the extrusion member 223. With respect to a printing unit in which the front end at the gripped side of the new printing plate 1 is not correctly attached on the lower plate cylinder, the actuator 219 of the lower printing plate holding device 210 of the printing unit is extended.

Upon detection of the abnormal attachment of the new printing plate 1, the new printing plate 1 is discharged by rotating the lower plate cylinder 13 of the printing unit in a reverse direction. At that time, the bent portion at the gripped side of the new printing plate 1, attached on the lower plate cylinder 13, is positioned near the press roller 271 contacting with the lower plate cylinder 13, and the press roller 271 is moved to the shelter position and released from the lower plate cylinder 13. By contracting the actuator 252 of the lower first printing plate guiding device 240, the guide roller 249 and the swing plate 250 are rotated about the rotational axis 247 in a counter clockwise direction so that the gripped side of the new printing plate 1 can be released from the lower plate cylinder 13 by the swing plate 250.

Next, the hook 225 is released from the engaging pin 229, and the claw portion 225*a* is rotated to advance into the stored portion 216*a* by the force urged by the spring 226. The claw portion 225*a* of the hook 225 is engaged with the rear end of the new printing plate 1, and the new printing plate 1 is returned to the storing portion 216*a* by extending the actuator 219 so that the gripped side of the new printing plate 1 can be prevented from being damaged.

Shift to a Shelter Position:

After discharging of the new printing plate 1 as described above, as shown in FIG. 21 the pivot frame is rotated by contracting the actuator 243 of the lower first printing plate guiding device 240 of the actuator 243 to move the guiding device 240 to the shelter position. The extrusion member 223 is moved toward the base end of the guide frame 212 by extending the actuator 219 of the lower printing plate holding device 210. The guide frames 212, 213 are rotated by contracting the actuator 230 to move the printing plate holding device 210 to the shelter position. Thus, each component, such as the guide frames 212, 213 passes through the safety covers 202, 203 and the opening portions 202*a*, 202*b*, 203*a*, and 203*b* and the slit 203*c*, and is stored at an interior side of the safety covers 202, 203, respectively.

At that time, the stored portion 216*b* of the lower printing plate holding device 210 is positioned at an exterior side with respect to the safety cover 203. Therefore, an operation for the stored portion 216*b* at the shelter position can be done at the exterior side with respect to the safety cover 203. Thus, the discharged printing plate 2 can be removed from the stored portion 216*b* very easily.

Almost all members of the lower printing plate holding device 210 except for the members related to the stored portions 216*a*, 216*b* are stored at an interior side with respect to the safety cover 203, so that an outward protruded amount of the safety cover 203 is small. Thus, a working space can be utilized effectively and the printing plates can be exchanged more conveniently.

Figure 22:
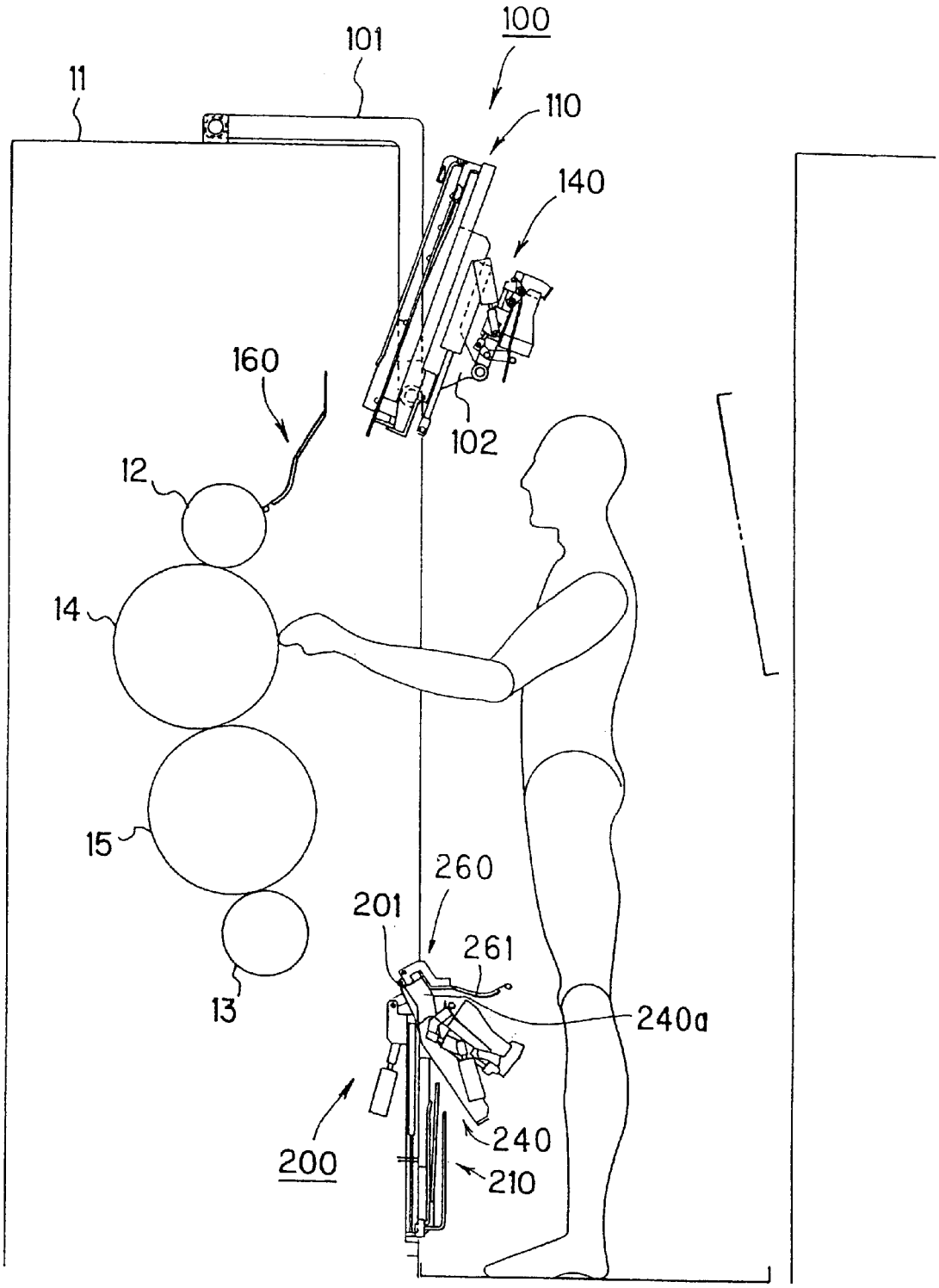
FIG. 22 shows a maintenance operation to inspect a surrounding portion of a rubber cylinder and a plate cylinder.

Maintenance of Blanket Cylinder and Surrounding Portion of the Plate Cylinder:

In the case of inspecting a surrounding portion of the plate cylinders 12, 13 and the blanket cylinders 14 , 15, the safety cover 103 is opened as shown in FIG. 22. Then, the support frame 102, integrally supported with the safety cover 103, is rotated with respect to the support arm 101. The upper printing plate holding device 110 and the upper first printing plate guiding device 140 are pulled from the frame 11. On the other hand, the support frame 240*a* of the lower first printing plate guiding device 240 and the guide plate 261 of the lower second printing plate guiding device 260 are rotated about the support axis 201, and the lower first printing plate guiding device 240 and the lower second printing plate guiding device 260 are pulled from the frame 11 of the printing unit. Thereby, the surrounding portions of the plate cylinders 12, 13 and the blanket cylinders 14, 15 of the printing portion in the printing unit can be released simultaneously while providing the working space at the surrounding portions of the plate cylinders 12, 13 and the blanket cylinders 14, 15 so that they can be inspected easily.

Figure 23:
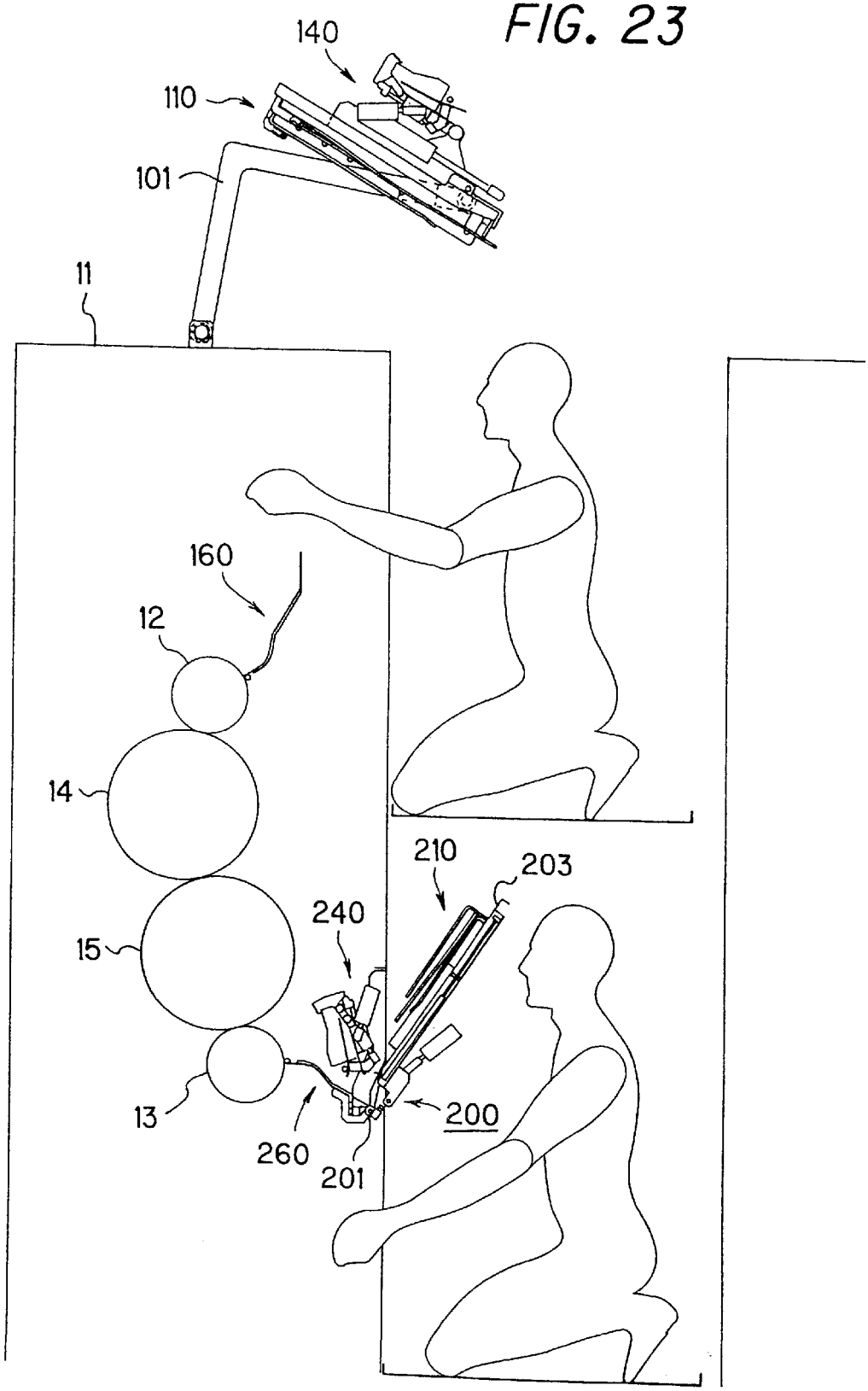
FIG. 23 shows a maintenance operation to inspect a surrounding portion of an ink supply device.

Inspection of the Surrounding Portion of the Ink Supply Device and a Water Supply Device:

When inspecting the surrounding proton of the ink supply device and the water supply device (portion above the upper plate cylinder 12, portion beyond the lower plate cylinder 13), the support arm 101 of the upper printing plate exchange device 100 is rotated by the frame 11 of the printing unit from a position as described above and as shown in FIG. 23. The upper printing plate holding device 110 and the upper first printing plate guiding device 140 are located above the frame 11 of the printing unit, and the lower printing plate holding device 210 with the safety cover 203 is pulled out from the printing unit by rotating the safety cover 203 of the lower printing plate exchange device 200 about the support axis 201. Thereby, the surrounding portion of the ink supply device and the water supply device of the printing portion of the printing unit can be released simultaneously while providing a working space at the surrounding portion of the ink supply device and the water supply device so that they can be inspected easily.

Advantages:

Accordingly, the above described upper printing plate exchange device 100 and lower printing plate exchange device 200 can obtain the following advantages.

(1) By only shifting the upper printing plate holding device 110 of the upper printing plate exchange device 100 to an operation position, the claw portions 125*a* and 126*a* of the hooks 125 and 126 are advanced in the stored portions 116*a* and 116*b*. By only shifting the upper printing plate holding device 110 to the shelter position, the claw portions 125*a*, 126*b* of the hooks 125, 126 move out from the stored portions 116*a*, 116*b*. Therefore, an insertion of the new printing plate 1 into the stored portion 116*b* and the removed of the discharged printing plate 2 from the stored portion 116*a* can be operated very easily without providing driving means for rotating the hooks 125, .126. Accordingly, although the structure is simple, the removal of the discharged printing plate 2 and the setting of the new printing plate 1 can be operated easily.

(2) At the shelter position, the downstream of the stored portion 116*a* of the upper printing plate holding device 110 of the upper printing plate exchange device 100 is located lower than the upstream of the stored portion 106*b* in the discharged printing plate storing direction. On the other hand, the upstream of the stored portion 116*b* is located lower than the downstream of the stored portion 116*b* in the new printing plate supplying direction. At the operation position, the downstream of the stored portion 116*a* of the upper printing holding device 110 of the upper printing plate exchange device 100 is located higher than the upstream of the stored portion 116*a* in the discharged printing plate storing direction, and the upper stream of the stored portion 116*b* is located higher than the downstream of the stored portion 116*b* in the new printing plate supplying direction. Therefore, the height of the stored portions 116*a*, 116*b* at the shelter position can be maintained lower. Thereby, although the printing portion is located relatively high, the printing plate 1 can be set easily and the discharged printing plate 2 can be removed easily.

(3) Since the stored portions 116*a*, 116*b* of the upper printing holding device 110 of the upper printing exchanging device 100 at the shelter position are located under the upper printing portion, the new printing plate 1 can be set easily and the discharged printing plate 2 can be removed easily even if the upper printing portion is located relatively high.

(4) The stored portions 116*a*, 116*b* of the upper printing plate holding device 110 of the upper printing plate exchange device 100 at the shelter position are located at the exterior side with respect to the safety cover 103, so that the new printing plate 1 and the discharged printing plate 2 can be set and removed without opening the safety cover 103.

(5) Since the guide rollers 162, 262 are provided at the end of the guide plates 161, 261 of the second printing plate guiding devices 160, 260 at the side of the plate cylinders 12, 13, the discharged printing plate 2 can be reliably disengaged from the end of the guide plates 161, 261 even if the bent end portion of the discharged printing portion 2 is caught. Although the discharged printing plate 2 is automatically discharged, the discharged printing plate 2 can be discharged certainly and the discharged printing plate 2 and the devices can be prevented from being damaged.

(6) Rotational axes of the lower first and second printing plate guiding devices 240, 260 and the safety cover 203 are the same, so that a working space can be obtained by rotating these devices. Although a sufficient space can not be obtained above the frame 11, the working space can be securely obtained at a portion surrounding with the plate cylinder 13 with small number of components.

(7) In order to move the stored portions 216*a*, 216*b* to the shelter position located at an exterior side with respect to the safety cover 203 and the operation position for connecting to the lower first printing plate change device 240 located in the guide position, the lower printing plate holding device 210 is pivotally provided at the cover 203 so that the new printing plate 1 and the discharged printing plate can be set and removed easily at the exterior side with respect to the safety cover 203.

(8) The guide plates 145, 245 of the fist printing plate guiding devices 140, 240 guide the discharged printing plate 2 to the stored portion 116*a*, 216*b* of the printing plate holding devices 110, 210. The new printing plate 1 from the stored portions 116*b*, 216*b* are guided to the plate cylinders 12, 13 so that the new printing plate 1 and the discharged printing plate 2 can be straggled.

(9) Without opening the safety covers 103, 203, the new printing plate 1 can be supplied and the discharged printing plate 2 can be stored by shifting the printing plate holding devices 110, 210 from the shelter position to the operation position. During the printing plates are being exchanged, the safety covers 103, 203 are located at a closed position so that the tools can be prevented from falling into the frame 11.

(10) The printing plate holding devices 110, 210 are held with respect to the safety covers 103, 203. Therefore, the printing holding devices 110, 210 can be released from the plate cylinders 12, 13 simultaneously with closing/opening the safety covers 103, 203. Thus, the inspection efficiency can be improved.

(11) Almost all members of the printing plate holding devices 110, 210 at the shelter position except for the members related to the stored portions 116*a*, 116*b*, 216*a*, and 216*b* can be stored at an interior side with respect to the safety covers 103, 203, so that an outward protruded amount of the safety covers 103, 203 is small. The working space can be utilized effectively and the printing plate exchange operation becomes more convenient.

(12) When the discharged printing plate 2 is removed from the stored portion 116*a* of the printing plate holding plate 110 or the new printing plate 1 is set to the stored portion 216*b* of the lower printing plate holding device 210, the safety covers 103, 203 can be used as the guide surface so that setting of the new printing plate 1 and removal of the discharged printing plate 2 can be operated easily with the simple members. Thus, the manufacturing cost can be reduced.

(13) Since the maximum rotational radius of the safety covers 103, 203 is shorter than the maximum rotational radius of the printing plate holding device 110, 210, the safety covers 103, 203 can be closed and opened easily without an operator colliding with the safety covers 103, 203 during the inspection.

(14) When the discharged printing plate 2 is completely released from the upper plate cylinder 12 or the lower plate cylinder 13, the guide plate 145 (245) is moved to the new printing plate guiding position temporarily by extending the actuator 146 (246) of the first printing plate guiding device 140 (240) so that the gripped side of the discharged printing plate 2 can be released from the guide plate 161 (261) of the second printing plate guiding device 160 (260). Therefore, the end portion of the plate cylinder 12 (13) of the guide plate 161 (261) can be prevented from being crashed at the gripped side of the discharged printing plate 2. Thus, the discharged printing plate 2 and the guide plates 161, 261 can be avoided from being damaged.

(15) The receiving board 232 is provided at the lower printing plate holding device 210. Even if the discharged printing plate 2 is moved toward the downstream with respect to the discharged printing plate storing direction under the gravity force before the gripped side of the discharged printing plate 2 is lifted by the guide plate 245, the receiving board 232 can receive the discharged printing plate 2. Thereby, the gripped side of the discharged printing plate 2 can be prevented from crashing into the front end of the guide plate 261. Thus, the discharged printing plate 2 and the guide plate 261 can be prevented for being damaged.

(16) When the new printing plate 1 is being attached to the upper plate cylinder 12 or the lower plate cylinder 13, an abnormal attachment may occur. In such a case, the printing press is stopped. With respect to a printing unit, at which the front end at the gripped side of the new printing plate 1 is not attached at the plate cylinder 12 (13), the rodless cylinder 120 and the actuator 219 of the printing plate holding device 110 (210) of the printing unit are operated. The new printing plate 1 is returned to the stored portion 116*b* (216*b*) so that the gripped side of the new printing plate 1 can be avoided from being damaged.

Figure 24A:
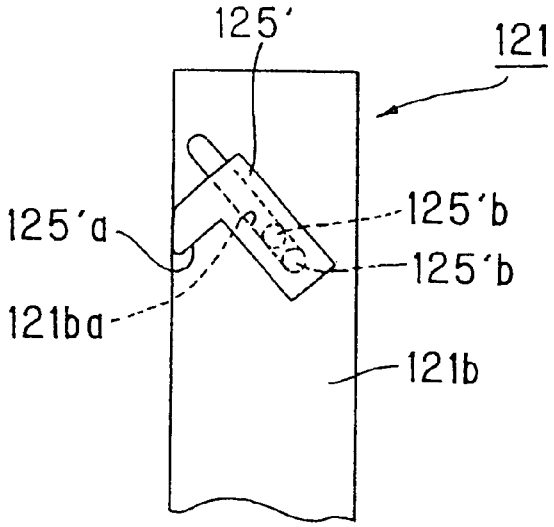
FIG. 24A is a view of an essential part of another embodiment of a printing plate holding device according to the present invention.
Figure 24B:
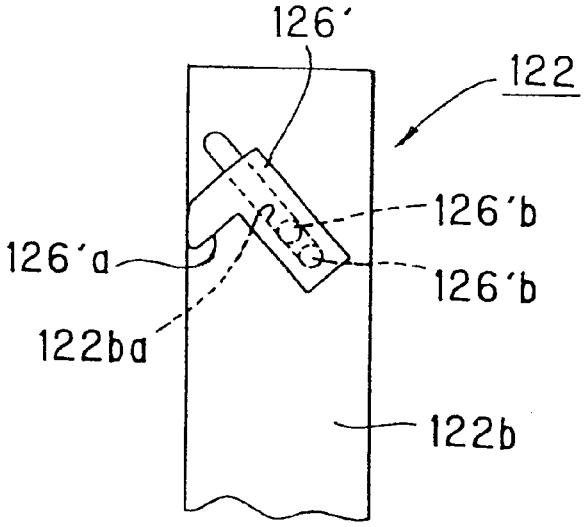
FIG. 24B is a view of an essential part of another embodiment of a printing plate holding device according to the present invention.

In the present embodiment, although the hooks 125, 126 are pivotally provided at the front ends 121*b*, 122*b* of the support members 121, 122, as shown in FIG. 24A and FIG. 24B, instead of the hooks 125, 126, hooks 125', 126' capable of sliding slide grooves 121*ba*, 122*ba* formed at the front end portions 121*b*, 122*b* of the support members 121, 122, via a pair of pins 125'*b*, 126'*b*, respectively, may be provided.

Figure 25A:
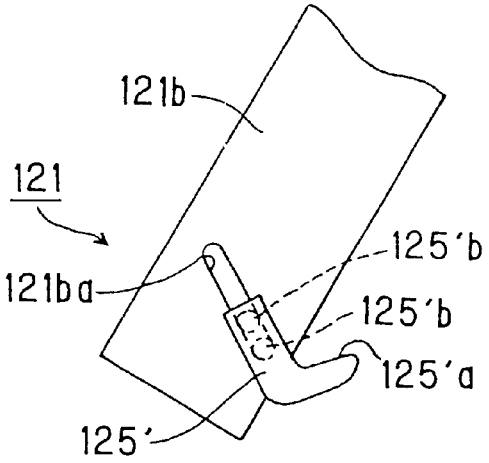
FIG. 25A shows an operation shown in FIG. 24A.
Figure 26A:
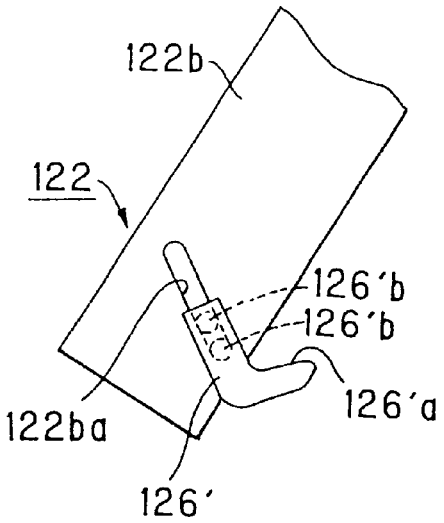
FIG. 26A shows an operation shown in FIG. 24B.
Figure 26B:
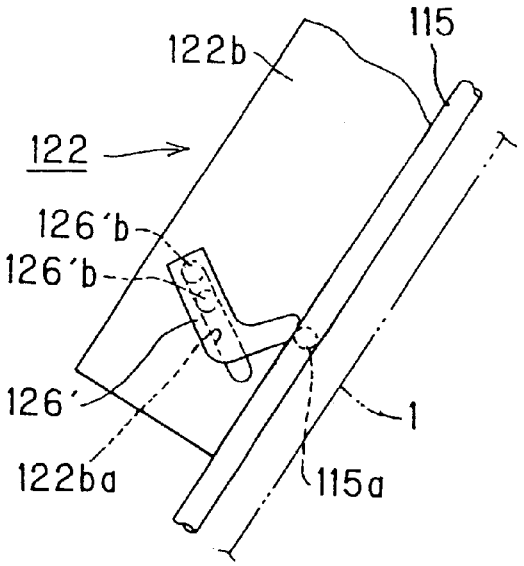
FIG. 26B shows an operation shown in FIG. 24B.

Regarding such hooks 125', 126', when the upper printing plate holding device 110 is switched to the operation position, the hooks 125', 126' are slid by its own weight to advance the claw portions 125'*a*, 126'*a* in the stored portions 116*a*, 116*b* (see FIG. 25A, FIG. 26B).

Figure 25B:
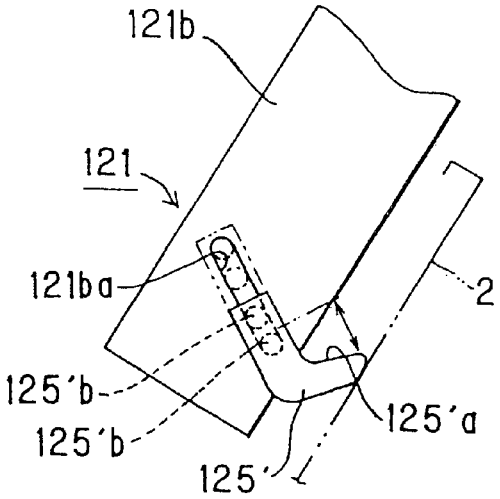
FIG. 25B shows an operation shown in FIG. 24A.

Therefore, regarding the hook 125' advanced in the stored portion 116*a*, the hook 125' is pushed by the tail end of the discharged printing plate 2 to go out from the stored portion 116*a* by feeding the discharged printing plate 2. At that time when the tail end of the discharged printing plate 2 passes, the hook 125' can slide into the stored portion 116*a* again by its own weight (see FIG. 25B). Regarding the hook 126' advanced in the stored portion 116*b*, the hook 126' is caught by the hooking member 115*a* of the guide member 115 on the way, the hook 126' can be slid to go out from the stored portion 116*b* (see FIG. 26B).

In the embodiment according to the present invention, although the hook 126 can go out from the stored portion 116*b* by making contact with the hooking member 115*a* of the guide member 115, instead of the hooking portion 115*a*, the hook 126 can be caught by a magnet member so that the hook 126 can go out from the stored portion 116*b* by moving the hook 126.

In the embodiment according to the present invention, although the pick up member 224 and the receiving board 232 are provided at the actuator 220 through the supporting member 222 and the bracket 231, the pick up member 224 and the receiving board 232 can be simultaneously moved by synchronizing the actuator 220 at which the pick up member 224 is provided and another actuator at which the receiving board 232 is provided.

According to a printing plate changing device of the present invention, new printing plate releasing means for releasing an end portion of the new printing plate at a down stream along a new printing plate supply direction from a plate cylinder is provided. Even if the new printing plate is abnormally attached to the plate cylinder, the end portion of the new printing plate is released from the plate cylinder so that the new printing plate, abnormally attached to the plate cylinder during/before an attachment operation, can be prevented from being damaged.

The new printing plate engagement member is advanced into a stored portion of a new printing plate storing means to engage with the end portion of the new printing plate by moving the new printing plate engagement member to an operation position of a new printing plate stored position of the new printing plate storing means with moving means. While the new printing plate engagement member is moved to a shelter position of the new printing plate storing means with the moving means, the new printing plate engagement member can be movably arranged with respect to the new printing plate storing means to be backwardly moved from the stored portion of the new printing plate storing means. Therefore, an operation for setting the new printing plate is easy and the new printing plate can be prevented from being damaged even if an abnormal attachment has happened during/before the attachment operation.

The present invention is, of course, in no way restricted to the specific disclosure of the specification and drawings, but also encompasses any modifications within the scope of the appended claims.

What is claimed is:

1. In a printing device a plate cylinder; and a printing plate changing device for supplying a new printing plate to the plate cylinder, comprising:

new printing plate separating means for separating an end portion of said new printing plate at a downstream side along a new printing plate supply direction from said plate cylinder.

2. The printing device as claimed in claim 1, wherein said new printing plate separating means separates said end portion from said plate cylinder when said new printing plate is abnormally attached.

3. The printing device as claimed in claim 1, further comprising:

a new printing plate storing means having a stored portion for storing said new printing plate, wherein said new printing plate separating means moves said new printing plate to store said new printing plate in said stored portion of said new printing plate storing means.

4. The printing device as claimed in claim 1, wherein said new printing plate separating means includes, a new printing plate engagement member for engaging with said end portion of said new printing plate at an upstream side along said new printing plate supply direction.

5. The printing device as claimed in claim 3, wherein said new printing plate separating means includes, a new printing plate engagement member movably arranged at said new printing plate storing means and engaging with said end portion of said new printing plate at the upstream side along the new printing plate supply direction.

6. The printing device as claimed in claim 5, further comprising: a new printing plate releasing member provided at a downstream side along a new printing plate storing direction with respect to a stored position at an upstream side of said new printing plate storing means along said new printing plate supply direction, wherein said new printing plate releasing member backwardly moves said new printing plate engagement member from said stored portion of said new printing plate storing means toward said downstream side along said new printing plate supply direction.

7. The printing device as claimed in claim 5, further comprising:

moving means for moving said new printing plate storing means between an operation position for supplying said new printing plate to said plate cylinder and a shelter position released from said plate cylinder, wherein said new printing plate engagement member is advanced into said stored portion of said new printing plate storing means to engage with said end portion of said new printing plate by moving said new printing plate storing means to said operation position by said moving means, and the new printing plate engagement member is movably provided with respect to said new printing plate storing means to backwardly move from said stored portion of said new printing plate storing means to said shelter position of said new printing plate storing means by said moving means.

8. The printing device as claimed in claim 7, wherein said upstream side of said stored portion along the new printing plate supply direction is located at a location lower than said downstream side of the new printing plate along said new printing plate supply direction in the case that said new printing plate storing means is in said shelter position, said new printing plate engagement member is pivotally supported on said new printing plate storing means, in the case that said new printing plate storing means is located at said shelter position, said new printing plate engagement member is located at a downstream side along said new printing plate supply direction with respect to an upstream end of said storing portion of said new printing plate storing means along said new printing plate supply direction, and a distance between a pivot point at said stored position of said new printing plate engagement member and the end portion at said upstream side of said stored portion of said new printing plate storing means along said new printing plate supply direction is longer than a distance between said pivot point and a front end of said new printing plate engagement member.

9. The printing device as claimed in claim 7, further comprising:

an urging member for advancing said new printing plate engagement member toward said stored portion; and a contacting member for backwardly moving said new printing plate engagement member from said stored portion of said new printing plate storing means against force urged by said urging member by contacting with said new printing plate engagement member.

10. The printing device as claimed in claim 1, wherein said new printing plate separating means moves an end portion of said new printing plate at said downstream side along said new printing plate supply direction along a substantially diameter direction of said plate cylinder.

11. The printing device as claimed in claim 10, wherein said new printing plate separating means includes a swing plate provided near said plate cylinder.

12. The printing device as claimed in claim 10, further comprising:

a discharged printing plate storing means having a stored portion for storing a discharged printing plate discharged from said plate cylinder, wherein said new printing plate separating means separates an upstream end portion of said discharged printing plate along a discharged printing plate storing direction, stored in the stored portion of said discharged printing plate storing means, from said plate cylinder.

13. A printing plate changing device for supplying a new printing plate to a plate cylinder, comprising:

sensor means for, during an attachment operation, detecting an abnormal attachment of the new printing plate to the plate cylinder; and new printing plate separating means for separating an end portion of said new printing plate at a downstream side along a new printing plate supply direction from said plate cylinder.

* * * * *